US010009705B2

(12) United States Patent
Seldess et al.

(10) Patent No.: US 10,009,705 B2
(45) Date of Patent: Jun. 26, 2018

(54) AUDIO ENHANCEMENT FOR HEAD-MOUNTED SPEAKERS

(71) Applicant: Boomcloud 360, Inc., Encinitas, CA (US)

(72) Inventors: Zachary Seldess, San Diego, CA (US); James Tracey, San Diego, CA (US); Alan Kraemer, San Diego, CA (US)

(73) Assignee: Boomcloud 360, Inc., Encinitas, CA (US)

( * ) Notice: Subject to any disclaimer, the term of this patent is extended or adjusted under 35 U.S.C. 154(b) by 0 days. days.

(21) Appl. No.: 15/404,948

(22) Filed: Jan. 12, 2017

(65) Prior Publication Data

US 2017/0230777 A1 Aug. 10, 2017

Related U.S. Application Data

(60) Provisional application No. 62/280,121, filed on Jan. 19, 2016, provisional application No. 62/388,367, filed on Jan. 29, 2016.

(51) Int. Cl.
*H04S 7/00* (2006.01)
*H04R 3/04* (2006.01)
(Continued)

(52) U.S. Cl.
CPC ..... *H04S 7/304* (2013.01); *H04R 3/04* (2013.01); *H04R 3/14* (2013.01); *H04R 5/033* (2013.01);
(Continued)

(58) Field of Classification Search
CPC ... H04S 7/00; H04S 3/00; H04S 1/002; H04R 3/04; H04R 3/14; H04R 5/033
See application file for complete search history.

(56) References Cited

U.S. PATENT DOCUMENTS 3,920,904 A * 11/1975 Blauert ..... H04S 1/005 381/310
2008/0031462 A1 2/2008 Walsh et al.
(Continued)

FOREIGN PATENT DOCUMENTS

CN 100481722 C 4/2009
CN 101884065 B 7/2013
(Continued)

OTHER PUBLICATIONS

PCT International Search Report and Written Opinion, PCT Application No. PCT/US2017/013061, Apr. 18, 2017, 12 pages.
(Continued)

*Primary Examiner* — Brenda C Bernardi
(74) *Attorney, Agent, or Firm* — Fenwick & West LLP

(57) ABSTRACT

Embodiments herein are primarily described in the context of a system, a method, and a non-transitory computer readable medium for producing a sound with enhanced spatial detectability and a crosstalk simulation. The audio processing system receives a left and right input channel of an audio input signal, and performs an audio processing to generate an output audio signal. The system generates left and right spatially enhanced signals by gain adjusting side subband components and mid subband components of the left and right input channels. The audio processing system generates left and right crosstalk channels such as by applying a filter and time delay to the left and right input channels, and mixes the spatially enhanced channels with the crosstalk channels. In some embodiments, the system includes high/low frequency enhancement channels and passthrough channels derived from the input channels, which can be mixed with the output audio signal.

20 Claims, 20 Drawing Sheets

(51) Int. Cl.

| | |
|---|---|
| ***H04R 3/14*** | (2006.01) |
| ***H04R 5/033*** | (2006.01) |
| ***H04S 3/00*** | (2006.01) |
| ***H04S 1/00*** | (2006.01) |

(52) U.S. Cl.
CPC ..... *H04S 1/005* (2013.01); *H04S 3/008* (2013.01); *H04S 2400/13* (2013.01); *H04S 2420/07* (2013.01)

(56) References Cited

U.S. PATENT DOCUMENTS

| | | | | |
|---|---|---|---|---|
| 2008/0165975 | A1* | 7/2008 | Oh | G10L 19/008 381/17 |
| 2008/0249769 | A1 | 10/2008 | Baumgarte | |
| 2008/0273721 | A1 | 11/2008 | Walsh | |
| 2009/0262947 | A1 | 10/2009 | Karlsson et al. | |
| 2009/0304189 | A1 | 12/2009 | Vinton | |
| 2011/0152601 | A1* | 6/2011 | Puria | H04R 25/606 600/25 |
| 2011/0188660 | A1 | 8/2011 | Xu et al. | |
| 2011/0268281 | A1 | 11/2011 | Florencio et al. | |
| 2012/0099733 | A1 | 4/2012 | Wang et al. | |

FOREIGN PATENT DOCUMENTS

| | | | |
|---|---|---|---|
| CN | 103765507 | B | 1/2016 |
| CN | 102893331 | B | 3/2016 |
| JP | 2013-013042 | A | 1/2013 |
| KR | 10-2009-0074191 | | 7/2009 |
| KR | 10-2012-0077763 | | 7/2012 |
| TW | 1484484 | | 5/2015 |
| TW | 1489447 | | 6/2015 |
| TW | 201532035 | A | 8/2015 |

OTHER PUBLICATIONS

PCT International Search Report and Written Opinion, PCT Application No. PCT/US2017/013249, Apr. 18, 2017, 20 pages.
"Bark scale," Wikipedia.org, Last Modified Jul. 14, 2016, 4 pages, [Online] [Retrieved on Apr. 20, 2017] Retrieved from the Internet<URL:https://en.wikipedia.org/wiki/Bark_scale>.
Taiwan Office Action, Taiwan Application No. 106101748, Aug. 15, 2017, 6 pages (with concise explanation of relevance).
Taiwan Office Action, Taiwan Application No. 106101777, Aug. 15, 2017, 6 pages (with concise explanation of relevance).

* cited by examiner

AUDIO ENHANCEMENT FOR HEAD-MOUNTED SPEAKERS

CROSS-REFERENCE TO RELATED APPLICATIONS

This application claims priority under 35 U.S.C. § 119(e) from U.S. Provisional Patent Application No. 62/280,121, entitled "BOA Algorithm Description," filed on Jan. 19, 2016, and U.S. Provisional Patent Application No. 62/388,367, entitled "BOA Algorithm Description," filed on Jan. 29, 2016, all of which are incorporated by reference herein in their entirety.

BACKGROUND

1. Field of the Disclosure

Embodiments of the present disclosure generally relate to the field of binaural and stereophonic audio signal processing and, more particularly, to optimizing audio signals for reproduction over head-mounted speakers, such as stereo earphones.

2. Description of the Related Art

Stereophonic sound reproduction involves encoding and reproducing signals containing spatial properties of a sound field using two or more transducers. Stereophonic sound enables a listener to perceive a spatial sense in the sound field. In a typical stereophonic sound reproduction system, two "in field" loudspeakers positioned at fixed locations in the listening field convert a stereo signal into sound waves. The sound waves from each in field loudspeaker propagate through space towards both ears of a listener to create an impression of sound heard from various directions within the sound field.

Head-mounted speakers, such as headphones or in-ear headphones, typically include a dedicated left speaker to emit sound into the left ear, and a dedicated right speaker to emit sound into the right ear. Sound waves generated by a head-mounted speaker operate differently from the sound waves generated by an in field loudspeaker, and such differences may be perceptible to the listener. The same input stereo signal can produce different, and sometimes less preferable, listening experiences when output from the head-mounted speakers and when output from the in field loudspeakers.

SUMMARY

An audio processing system adaptively produces two or more output channels for reproduction by creating simulated contralateral crosstalk signals for each of the output channels, and combining those simulated signals with spatially enhanced signals. The audio processing system can enhance the listening experience over head-mounted speakers, and works effectively over a wide variety of content including music, movies, and gaming. The audio processing system include flexible configurations (e.g., of filters, gains, and delays) that provide dramatic acoustically satisfying experiences that particularly enhance the spatial sound field experienced by the listener. For example, the audio processing system can provide to head-mounted speakers a sound field comparable to that experienced when listening to stereo content over in field loudspeakers, In some embodiments, the audio processing system receives an input audio signal including a left input channel and a right input channel. Using the left and right input channels, the audio processing system generates a spatially enhanced left and right channel, left and right crosstalk channels, low frequency and high frequency enhancement channels, mid channels, and passthrough channels. The audio processing system mixes the generated channels, such as by applying different gains to the channels, to generate the left and right output channels. In one aspect, the audio processing system improves the listening experience of the audio input signal when output to head-mounted speakers, simulating the contralateral signal components that are characteristic of sound wave behavior of in field speakers. The simulated contralateral signals account for both the additional delay that would result from the opposing channel speaker, as well as the filtering effect that would result from the listener's head and ear. The filtering effect is provided by a filter function for a head shadow effect for the respective audio channel. As such, the spatial sense of the sound field is improved and the sound field is expanded, resulting in a more enjoyable listening experience for head-mounted speakers.

The spatially enhanced channels further enhance the spatial sense of the sound field by gain adjusting side subband components and mid subband components of the left and right input channels. The low and high frequency channels respectively boost low and high frequency components of the input channels. The mid and passthrough channels control the contribution of the (e.g., non-spatially enhanced) input audio signal to the output channels.

Some embodiments include a method for generating the output channels, including: receiving an input audio signal comprising a left input channel and a right input channel; generating a spatially enhanced left channel and a spatially enhanced right channel by gain adjusting side subband components and mid subband components of the left and right input channels; generating a left crosstalk channel by filtering and time delaying the left input channel; generating a right crosstalk channel by filtering and time delaying the right input channel; generating a left output channel by mixing the spatially enhanced left channel and the right crosstalk channel; and generating a right output channel by mixing the spatially enhanced right channel and the left crosstalk channel.

Some embodiments include an audio processing system including: a subband spatial enhancer configured to generate a spatially enhanced left channel and a spatially enhanced right channel by gain adjusting side subband components and mid subband components of a left input channel and a right input channel; a crosstalk simulator configured to: generate a left crosstalk channel by filtering and time delaying the left input channel; and generate a right crosstalk channel by filtering and time delaying the right input channel; and a mixer configured to: generate a left output channel by mixing the spatially enhanced left channel and the right crosstalk channel; and generate a right output channel by mixing the spatially enhanced right channel and the left crosstalk channel.

Some embodiments may include a non-transitory computer readable medium configured to store program code, the program code comprising instructions that when executed by a processor cause the processor to: receive an input audio signal comprising a left input channel and a right input channel; generate a spatially enhanced left channel and a spatially enhanced right channel by gain adjusting side subband components and mid subband components of the left and right input channels; generate a left crosstalk channel by filtering and time delaying the left input channel; generate a right crosstalk channel by filtering and time delaying the right input channel; generate a left output channel by mixing the spatially enhanced left channel and the right crosstalk channel; and generate a right output channel by mixing the spatially enhanced right channel and the left crosstalk channel.

DETAILED DESCRIPTION

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

The Figures (FIG.) and the following description relate to the preferred embodiments by way of illustration only. It should be noted that from the following discussion, alternative embodiments of the structures and methods disclosed herein will be readily recognized as viable alternatives that may be employed without departing from the principles of the present invention.

Reference will now be made in detail to several embodiments of the present invention(s), examples of which are illustrated in the accompanying figures. It is noted that wherever practicable similar or like reference numbers may be used in the figures and may indicate similar or like functionality. The figures depict embodiments for purposes of illustration only. One skilled in the art will readily recognize from the following description that alternative embodiments of the structures and methods illustrated herein may be employed without departing from the principles described herein.

Example Audio Processing System

Figure 1:
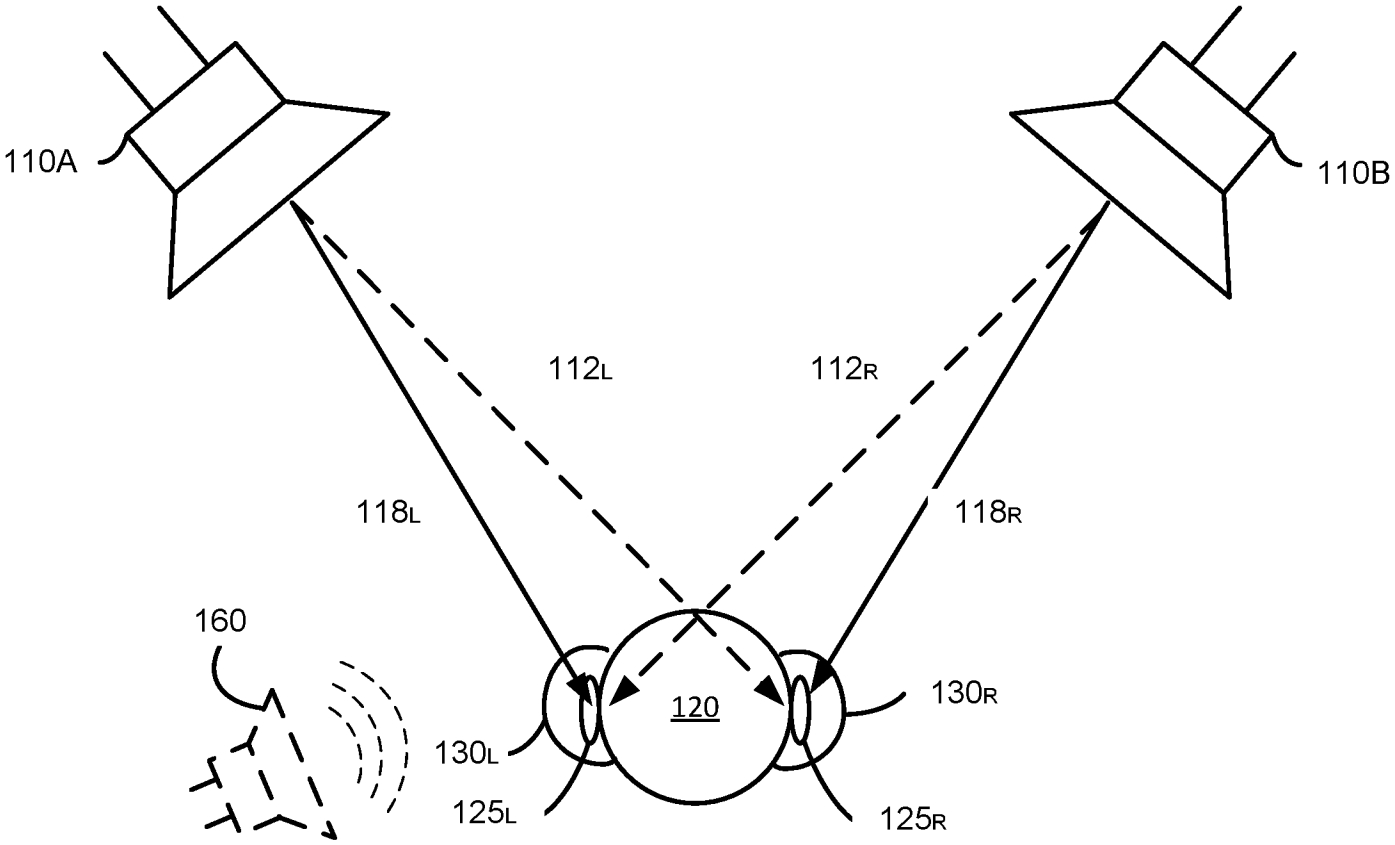
FIG. 1 illustrates a stereo audio reproduction system.

With reference to FIG. 1, two in field loudspeakers 110A and 110B positioned at fixed locations in a listening field convert a stereo signal into sound waves, which propagate through space towards a listener 120 to create an impression of sound heard from various directions (e.g., the imaginary sound source 160) within the sound field.

Head-mounted speakers, such as headphones or in-ear headphones, include a dedicated left speaker $\mathbf{130}_L$ to emit sound into the left ear $\mathbf{125}_L$ and a dedicated right speaker $\mathbf{130}_R$ to emit sound into the right ear $\mathbf{125}_R$. As such, signal reproduction by head-mounted speakers operates differently from signal reproduction on the in field loudspeakers 110A and 110B in various ways.

Unlike head-mounted speakers, for example, the loudspeakers 110A and 110B positioned a distance from the listener each produce "trans-aural" sound waves that are received at both the left and right ears $\mathbf{125}_L$, $\mathbf{125}_R$ of the listener 120. The right ear $\mathbf{125}_R$ receives the signal component $\mathbf{112}_L$ from the loudspeaker 110A at a slight delay relative to when the left ear $\mathbf{125}_L$ receives a signal component $\mathbf{118}_L$ from the loudspeaker 110A. Time delay of the signal component $\mathbf{112}_L$ relative to the signal component $\mathbf{118}_L$ is caused by a larger distance between loudspeaker 110A and the right ear $\mathbf{125}_R$ as compared to the distance between loudspeaker 110A and the left ear $\mathbf{125}_L$. Similarly, the left ear $\mathbf{125}_L$ receives the signal component $\mathbf{112}_R$ from the loudspeaker 110B at slight delay relative to when the right ear $\mathbf{125}_R$ receives a signal component $\mathbf{118}_R$ from the loudspeaker 110B.

Head-mounted speakers emit sound waves close to the user's ears, and therefore generate lower or no trans-aural sound wave propagation, and thus no contralateral components. Each ear of the listener 120 receives an ipsilateral sound component from a corresponding speaker, and no contralateral crosstalk sound component from the other speaker. Accordingly, the listener 120 will perceive a different, and typically smaller sound field with head-mounted speakers.

Figure 2:
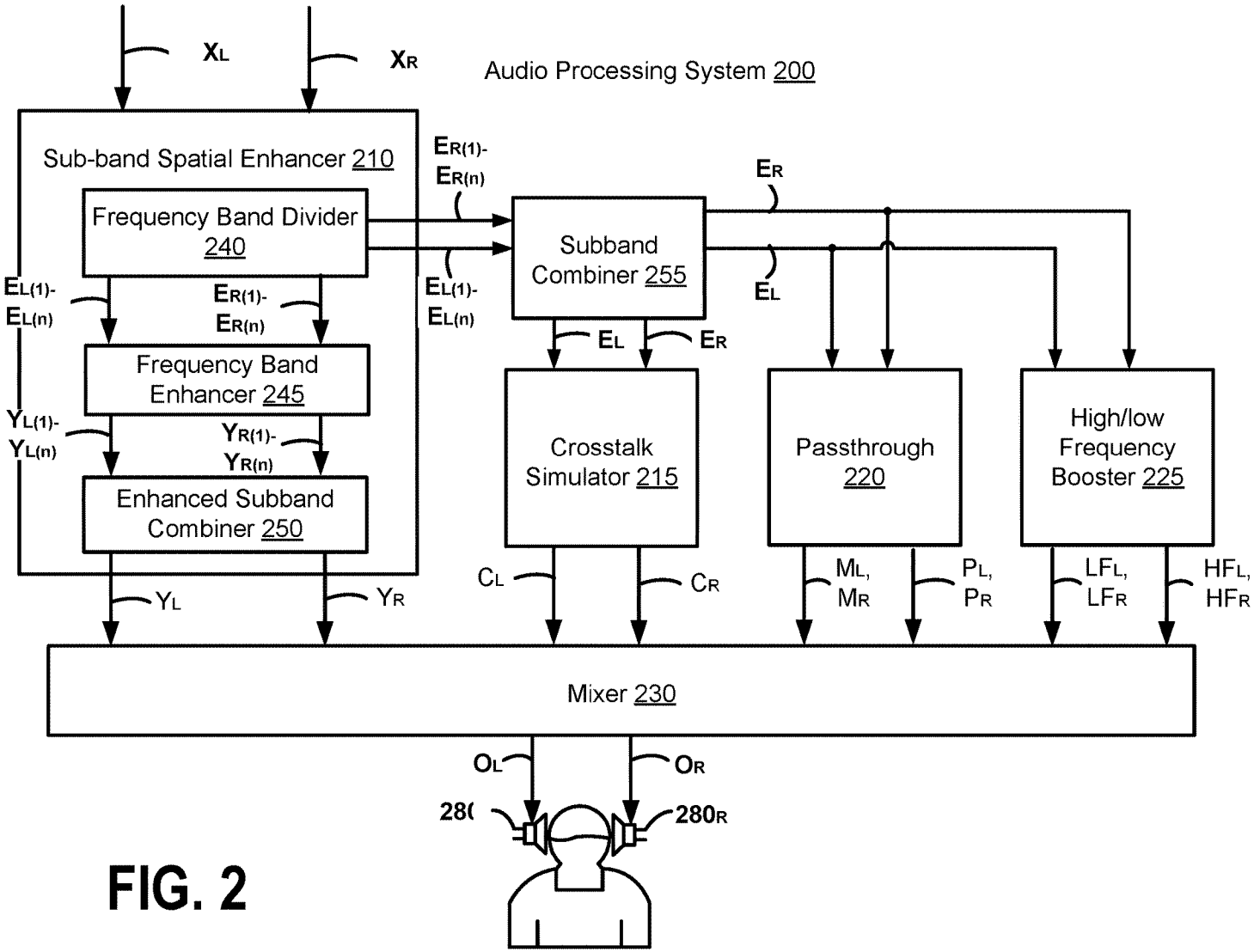
FIG. 2 illustrates an example audio processing system, according to one embodiment.

FIG. 2 illustrates an example of an audio processing system 200 for processing an audio signal for head-mounted speakers, in accordance with one embodiment. The audio processing system 200 includes a subband spatial enhancer 210, a crosstalk simulator 215, a passthrough 220, a high/low frequency booster 225, a mixer 230, and a subband combiner 255. The components of the audio processing system 200 may be implemented in electronic circuits. For example, a hardware component may comprise dedicated circuitry or logic that is configured (e.g., as a special purpose processor, such as a digital signal processor (DSP), field programmable gate array (FPGA) or an application specific integrated circuit (ASIC)) to perform certain operations disclosed herein.

The system 200 receives an input audio signal X comprising two input channels, a left input channel $X_L$ and a right input channel $X_R$. The input audio signal X may be a stereo audio signal with different left and right input channels. Using the input audio signal X, the system generates an output audio signal O comprising two output channels $O_L$, $O_R$. As discussed in greater detail below, the output audio signal O is a mixture of a spatial enhancement signal, a simulated cross talk signal, low/high frequency enhancement signal, and/or other processing outputs based on the input audio signal X. When output to head-mounted speakers 280$_L$ and 280$_R$, the output audio signal O provides a listening experience comparable to that of larger in field loudspeaker systems, such as in terms of sound field size, spatial sound control, and tonal characteristics.

The subband spatial enhancer 210 receives input audio signal X and generates a spatially enhanced signal Y, including a spatially enhanced left channel $Y_L$ and a spatially enhanced right channel $Y_R$. The subband spatial enhancer 210 includes a frequency band divider 240, a frequency band enhancer 245, and an enhanced subband combiner 250. The frequency band divider 240 receives the left input channel $X_L$ and the right input channel $X_R$, and divides the left input channel $X_L$ into left subband components $E_L(\mathbf{1})$ through $E_L(n)$ and the right input channel $X_R$ into right subband components $E_R(\mathbf{1})$ through $E_R(n)$, where n is the number of subbands (e.g., 4). The n subbands define a group of n frequency bands, with each subband corresponding with one of the frequency bands.

The frequency band enhancer 245 enhances spatial components of the input audio signal X by altering intensity ratios between mid and side subband components of the left subband components $E_L(\mathbf{1})$ through $E_L(n)$, and altering intensity ratios between mid and side subband components of the right subband components $E_R(\mathbf{1})$ through $E_R(n)$. For each frequency band, the frequency band enhancer generates mid and side subband components (e.g., $E_m(\mathbf{1})$ and $E_s(\mathbf{1})$, for the frequency band n=1) from corresponding left subband and right subband components (e.g., $E_L(\mathbf{1})$ and $E_R(\mathbf{1})$, applies different gains to the mid and side subband components to generate an enhanced mid subband component and an enhanced side subband component (e.g., $Y_m(\mathbf{1})$ and $Y_s(\mathbf{1})$), and then converts the enhanced mid and side subband components into left and right enhanced subband channels (e.g., $Y_L(\mathbf{1})$ and $Y_R(\mathbf{1})$). As such, the frequency band enhancer 245 generates enhanced left subband channels $Y_L(\mathbf{1})$ through $Y_L(n)$ and enhanced right subband channels $Y_R(\mathbf{1})$ through $Y_R(n)$, where n is the number of subband components.

The enhanced subband combiner 250 generates the spatially enhanced left channel $Y_L$ from the enhanced left subband channels $Y_L(\mathbf{1})$ through $Y_L(n)$, and generates the spatially enhanced right channel $Y_R$ from the enhanced right subband channels $Y_R(\mathbf{1})$ through $Y_R(n)$.

The subband combiner 255 generates a left subband mix channel $E_L$ by combining the left subband components $E_L(\mathbf{1})$ through $E_L(n)$, and generates a right subband mix channel $E_R$ by combining the right subband components $E_R(\mathbf{1})$ through $E_R(n)$. The left subband mix channel $E_L$ and right subband mix channel $E_R$ are used as inputs for the crosstalk simulator 215, the passthrough 220, and/or the high/low frequency booster 225. In some embodiments, the subband band combiner 255 is integrated with one of the subband spatial enhancer 210, the crosstalk simulator 215, the passthrough 220, or the high/low frequency booster 225. For example, if the subband band combiner 255 is part of the crosstalk simulator 215, then the crosstalk simulator 215 may provide the left subband mix channel $E_L$ and right subband mix channel $E_R$ to the passthrough 220 and/or the high/low frequency booster 225.

In some embodiments, the subband combiner 255 is omitted from the system 200. For example, the crosstalk simulator 215, the passthrough 220, and/or the high/low frequency booster 225 may receive and process the original audio input channels $X_L$ and $X_R$ instead of the subband mix channels $E_L$ and $E_R$.

The crosstalk simulator 215 generates a "head shadow effect" from the audio input signal X. The head shadow effect refers to a transformation of a sound wave caused by trans-aural wave propagation around and through the head of a listener, such as would be perceived by the listener if the audio input signal X was transmitted from the loudspeakers 110A and 110B to each of the left and right ears 125$_L$ and 125$_R$ of the listener 120 as shown in FIG. 1. For example, the crosstalk simulator 215 generates a left crosstalk channel $C_L$ from the left channel $E_L$ and a right crosstalk channel $C_R$ from the right channel $E_R$. The left crosstalk channel $C_L$ may be generated by applying a low-pass filter, delay, and gain to the left subband mix channel $E_L$. The right crosstalk channel $C_R$ may be generated by applying a low-pass filter, delay, and gain to the right subband mix channel $E_R$. In some embodiments, low shelf filters or notch filters may be used rather than low-pass filters to generate the left crosstalk channel $C_L$ and right crosstalk channel $C_R$ The passthrough 220 generates a mid (L+R) channel by adding the left subband mix channel $E_L$ and the right subband mix channel $E_R$. The mid channel represents audio data that is common to both the left subband mix channel $E_L$ and the right subband mix channel $E_R$. The mid channel can be separated into a left mid channel $M_L$ and a right mid channel $M_R$. The passthrough 220 generates a left passthrough channel $P_L$ and a right passthrough channel $P_R$. The passthrough channels represent the original left and right audio input signals $X_L$ and $X_R$, or the left subband mix channel $E_L$ and the right subband mix channel $E_R$ generated from the audio input signals $X_L$ and $X_R$ by the frequency band divider 245.

The high/low frequency booster 225 generates low frequency channels $LF_L$ and $LF_R$, and high frequency channels $HF_L$ and $HF_R$ from the audio input signal X. The low and high frequency channels represent frequency dependent enhancements to the audio input signal X. In some embodiments, the type or quality of frequency dependent enhancements can be set by the user.

The mixer 230 combines the output of the subband spatial enhancer 210, the crosstalk simulator 215, the passthrough 220, and the high/low frequency booster 225 to generate an audio output signal O that includes left output signal $O_L$ and right output signal $O_R$. The left output signal $O_L$ is provided to the left speaker 235$_L$ and the right output signal $O_R$ is provided to the right speaker 235$_R$.

The output signal O generated by the mixer 230 is a weighted combination of outputs from the subband spatial enhancer 210, the crosstalk simulator 215, the passthrough 220, and the high/low frequency booster 225. For example, the left output channel $O_L$ includes a combination of the spatially enhanced left channel $Y_L$, right crosstalk channel $C_R$ (e.g., representing the contralateral signal from a right loudspeaker that would be heard by the left ear via trans-aural sound propagation), and preferably further includes a combination of the left mid channel $M_L$, the left passthrough channel $P_L$, and the left low and high frequency channels $LF_L$ and $HF_L$. The right output channel $O_R$ includes a combination of the spatially enhanced right channel $Y_R$, left crosstalk channel $C_L$ (e.g., representing the contralateral signal from a left loudspeaker that would be heard by the right ear via trans-aural sound propagation), and preferably further includes a combination of the right mid channel $M_R$, the right passthrough channel $P_R$, and the right low and high frequency channels $LF_R$ and $HF_R$. The relative weights of the signals input to the mixer 230 can be controlled by the gains applied to each of the inputs.

Detailed example embodiments of the subband spatial enhancer 210, subband band combiner 255, crosstalk simulator 215, passthrough 220, high/low frequency booster 225, and mixer 230 are shown in FIGS. 3A through 8, and discussed in greater detail below.

Figure 3A:
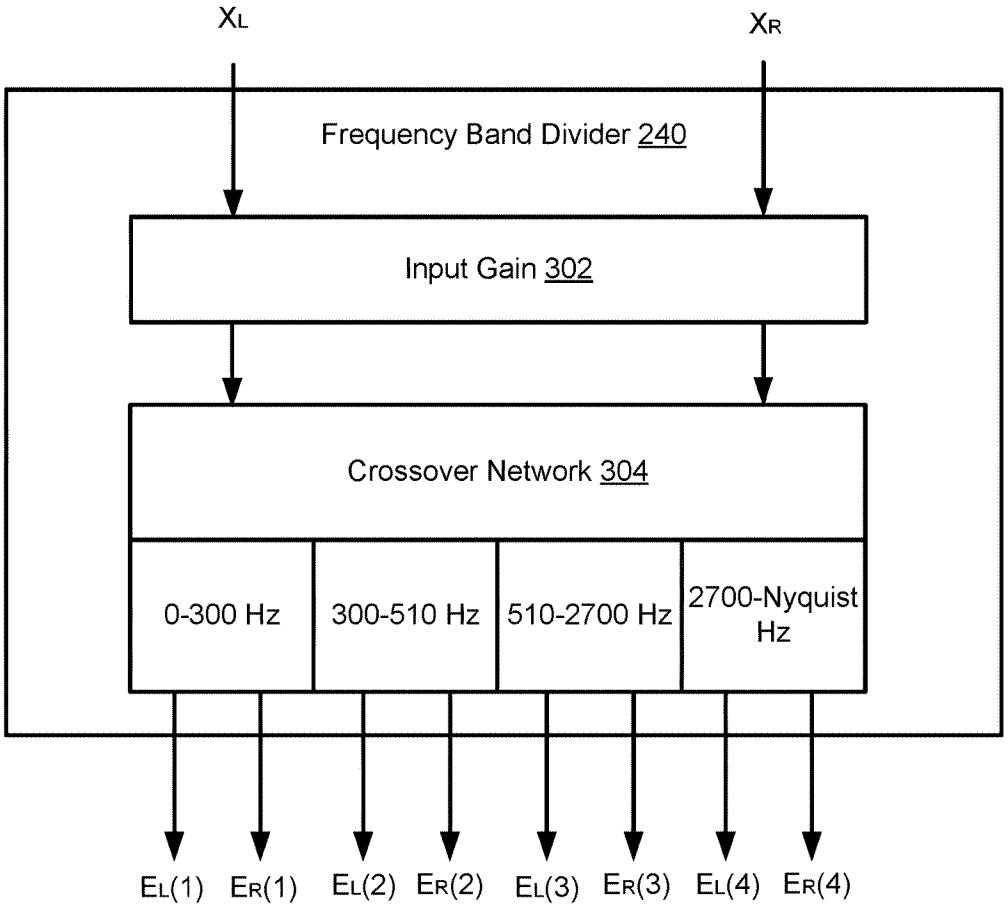
FIG. 3A illustrates a frequency band divider of a subband spatial enhancer, in accordance with one embodiment.

FIG. 3A illustrates the frequency band divider 240 of the subband spatial enhancer 210, in accordance with one embodiment. The frequency band divider 240 divided the left input channel $X_L$ into left subband components $E_L(k)$, and divides the right input channel $X_R$ into right subband components $E_R(k)$ for a defined n frequency subbands k. The frequency band divider 240 includes an input gain 302 and a crossover network 304. The input gain 302 receives the left input channel $X_L$ and the right input channel $X_R$, and applies a predefined gain to each of the left input channel $X_L$ and the right input channel $X_R$. In some embodiments, the same gain is applied to each of the left and right input channels $X_L$ and $X_R$. In some embodiments, the input gain 302 applies a −2 dB gain to the input audio signal X. In some embodiments, the input gain 302 is separate from the frequency band divider 240, or omitted from the system 200 such that no gain is applied to the input audio signal X.

The crossover network 304 receives the input audio signal X from the input gain 302, and divides the input audio signal X into subband signals E(K). The crossover network 304 may use various types of filters arranged in any of various circuit topologies, such as serial, parallel, or derived, so long as the resulting outputs form a set of signals for contiguous subbands. Example filter types included in the crossover network 304 may include infinite impulse response (IIR) or finite impulse response (FIR) bandpass filters, IIR peaking and shelving filters, Linkwitz-Riley, or the like. The filters divide the left input channel $X_L$ into left subband components $E_L(k)$, and divide the right input channel $X_R$ into right subband components $E_R(k)$ for each frequency subband k. In one approach, a number of bandpass filters, or any combinations of low pass filter, bandpass filter, and a high pass filter, are employed to approximate combinations of the critical bands of the human ear. A critical band corresponds to the bandwidth within which a second tone is able to mask an existing primary tone. For example, each of the frequency subbands may correspond to a group of consolidated Bark scale critical bands. For example, the crossover network 304 divides the left input channel $X_L$ into the four left subband components $E_L(\mathbf{1})$ through $E_L(\mathbf{4})$, corresponding to 0 to 300 Hz (corresponding to Bark scale bands 1-3), 300 to 510 Hz (e.g., Bark scale bands 4-5), 510 to 2700 Hz (e.g., Bark scale bands 6-15), and 2700 Hz to Nyquist frequency (e.g., Bark scale 7-24) respectively, and similarly divides the right input channel $X_R$ into the right subband components $E_R(\mathbf{1})$ through $E_R(\mathbf{4})$, for corresponding frequency bands. The process of determining a consolidated set of critical bands includes using a corpus of audio samples from a wide variety of musical genres, and determining from the samples a long term average energy ratio of mid to side components over the 24 Bark scale critical bands. Contiguous frequency bands with similar long term average ratios are then grouped together to form the set of critical bands. In other implementations, the filters separate the left and right input channels into fewer or greater than four subbands. The range of frequency bands may be adjustable. The crossover network 304 outputs a pair of a left subband components $E_L(k)$ and a right subband components $E_R(k)$, for k=1 to n, where n is the number of subbands (e.g., n=4 in FIG. 3A).

The crossover network 304 provides the left subband components $E_L(\mathbf{1})$ through $E_L(n)$ and the right subband components $E_L(\mathbf{1})$ through $E_L(n)$ to the frequency band enhancer 245 of the subband spatial enhancer 210. As discussed in greater detail below, the left subband components $E_L(\mathbf{1})$ through $E_L(n)$ and the right subband components $E_L(\mathbf{1})$ through $E_L(n)$ may also provided to the crosstalk simulator 215, passthrough 220, and high/low frequency booster 225.

Figure 3B:
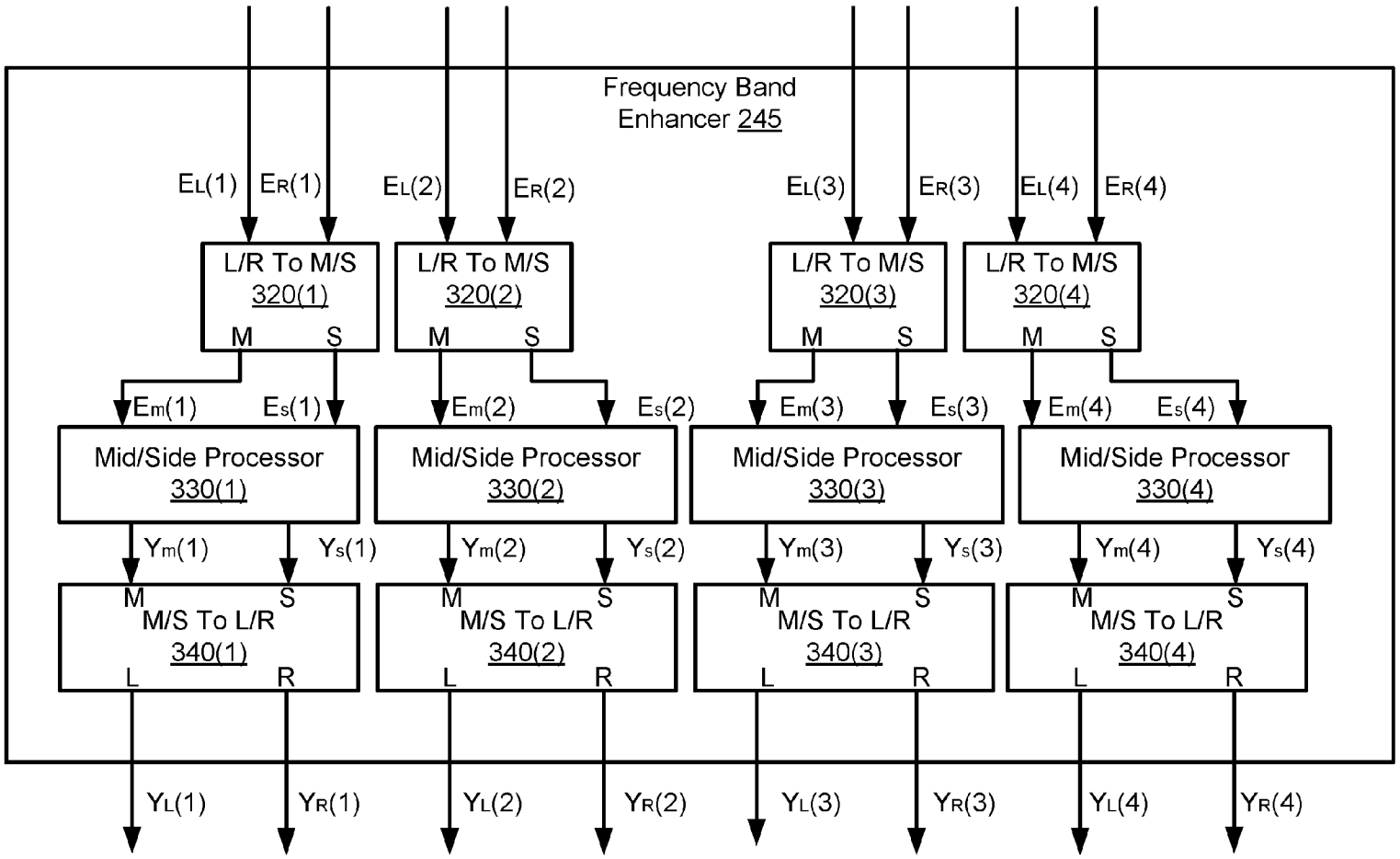
FIG. 3B illustrates a frequency band enhancer of the subband spatial enhancer, in accordance with one embodiment.

FIG. 3B illustrates the frequency band enhancer 245 of the subband spatial enhancer 210, in accordance with one embodiment. The frequency band enhancer 245 generates a spatially enhanced left subband components $Y_L(\mathbf{1})$ through $Y_L(n)$ and spatially enhanced right subband components $Y_R(\mathbf{1})$ through $Y_R(n)$ from the left subband components $E_L(\mathbf{1})$ through $E_L(n)$ and the right subband components $E_L(\mathbf{1})$ through $E_L(n)$.

The frequency band enhancer 245 includes, for each subband k (where k=1 through n), an L/R to M/S converter 320(*k*), a mid/side processor 330(*k*), and a M/S to L/R converter 340(*k*). Each L/R to M/S converter 320(*k*) receives a pair of enhanced subband components $E_L(k)$ and $E_R(k)$, and converts these inputs into a mid subband component $E_m(k)$ and a side subband component $E_s(k)$. The mid subband component $E_m(k)$ is a non-spatial subband component that corresponds to a correlated portion between the left subband component $E_L(k)$ and the right subband component $E_R(k)$, hence, includes nonspatial information. In some embodiments, the mid subband component $E_m(k)$ is computed as a sum of the subband components $E_L(k)$ and $E_R(k)$. The side subband component $E_s(k)$ is a nonspatial subband component that corresponds to a non-correlated portion between the left subband component $E_L(k)$ and the right subband component $E_R(k)$, hence includes spatial information. In some embodiments, the side subband component $E_s(k)$ is computed as a difference between the left subband component $E_L(k)$ and the right subband component $E_R(k)$. In one example, the L/R to M/S converter 320 obtains nonspatial subband component $E_m(k)$ and the spatial subband component $E_s(k)$ and of the frequency subband k according to a following equations:

$$E_m(k)=E_L(k)+E_R(k) \quad \text{Eq. (1)}$$

$$E_s(k)=E_L(k)-E_R(k) \quad \text{Eq. (2)}$$

For each subband k, a mid/side processor 330(*k*) adjusts the received side subband component $E_s(k)$ to generate an enhanced spatial side subband component $Y_s(k)$, and adjusts the received mid subband component $E_m(k)$ to generate enhanced mid subband component $Y_m(k)$. In one embodiment, the mid/side processor 330(*k*) adjusts the mid subband component $E_m(k)$ by a corresponding gain coefficient $G_m(k)$, and delays the amplified nonspatial subband component $G_m(k)*E_m(k)$ by a corresponding delay function $D_m$ to generate an enhanced mid subband component $Y_m(k)$. Similarly, the mid/side processor 330(*k*) adjusts the received side subband component $E_s(k)$ by a corresponding gain coefficient $G_s(k)$, and delays the amplified spatial subband component $G_s(k)*X_s(k)$ by a corresponding delay function $D_s$ to generate an enhanced side subband component $Y_s(k)$. The gain coefficients and the delay amount may be adjustable. The gain coefficients and the delay amount may be determined according to the speaker parameters or may be fixed for an assumed set of parameter values. The mid/side processor 430(*k*) of a frequency subband k generates the enhanced mid subband component $Y_m(k)$ and the enhanced side subband component $Y_m(k)$ according to following equations:

$$Y_m(k)=G_m(k)*D_m(E_m(k),k) \quad \text{Eq. (3)}$$

$$Y_s(k)=G_s(k)*D_s(E_s(k),k) \quad \text{Eq. (4)}$$

Each mid/side processor 330(*k*) outputs the mid (non-spatial) subband component $Y_m(k)$ and the side (spatial) subband component $Y_s(k)$ to a corresponding M/S to L/R converter 340(*k*) of the respective frequency subband k. Examples of gain and delay coefficients are listed in the following Table 1.

TABLE 1

Example configurations of mid/side processors.

| | Subband 1 (0-300 Hz) | Subband 2 (300-510 Hz) | Subband 3 (510-2700 Hz) | Subband 4 (2700-24000 Hz) |
|---|---|---|---|---|
| $G_m$(dB) | −1 | 0 | 0 | 0 |
| $G_s$ (dB) | 2 | 7.5 | 6 | 5.5 |
| $D_m$ (samples) | 0 | 0 | 0 | 0 |
| $D_s$ (samples) | 5 | 5 | 5 | 5 |

In some embodiments, the mid/side processor 330(1) for the 0 to 300 Hz subband applies a 0.5 dB gain to the mid subband component $E_m$(1) and a 4.5 dB gain to the side subband component $E_s$(1). The mid/side processor 330(2) for the 300 to 510 Hz subband applies a 0 dB gain to the mid subband component $E_m$(2) and a 4 dB gain to the side subband component $E_s$(2). The mid/side processor 330(3) for the 510 to 2700 Hz subband applies a 0.5 dB gain to the mid subband component $E_m$(3) and a 4.5 dB gain to the side subband component $E_s$(3). The mid/side processor 330(4) for the 2700 Hz to Nyquist frequency subband applies a 0 dB gain to the mid subband component $E_m$(4) and a 4 dB gain to the side subband component $E_s$(3).

Each M/S to L/R converter 340(*k*) receives an enhanced subband mid component $Y_m(k)$ and an enhanced subband side component $Y_s(k)$, and converts them into an enhanced left subband component $Y_L(k)$ and an enhanced right subband component $Y_R(k)$. If the L/R to M/S converter 320(*k*) generates the mid subband component $E_m(k)$ and the side subband component $E_s(k)$ according to Eq. (1) and Eq. (2) above, the M/S to L/R converter 340(*k*) generates the enhanced left subband component $Y_L(k)$ and the enhanced right subband component $Y_R(k)$ of the frequency subband k according to following equations:

$$Y_L(k)=(Y_m(k)+Y_s(k))/2 \quad \text{Eq. (5)}$$

$$Y_R(k)=(Y_m(k)-Y_s(k))/2 \quad \text{Eq. (6)}$$

In some embodiment, $E_L(k)$ and $E_R(k)$ in Eq. (1) and Eq. (2) may be swapped, in which case $Y_L(k)$ and $Y_R(k)$ in Eq. (5) and Eq. (6) are swapped as well.

Figure 3C:
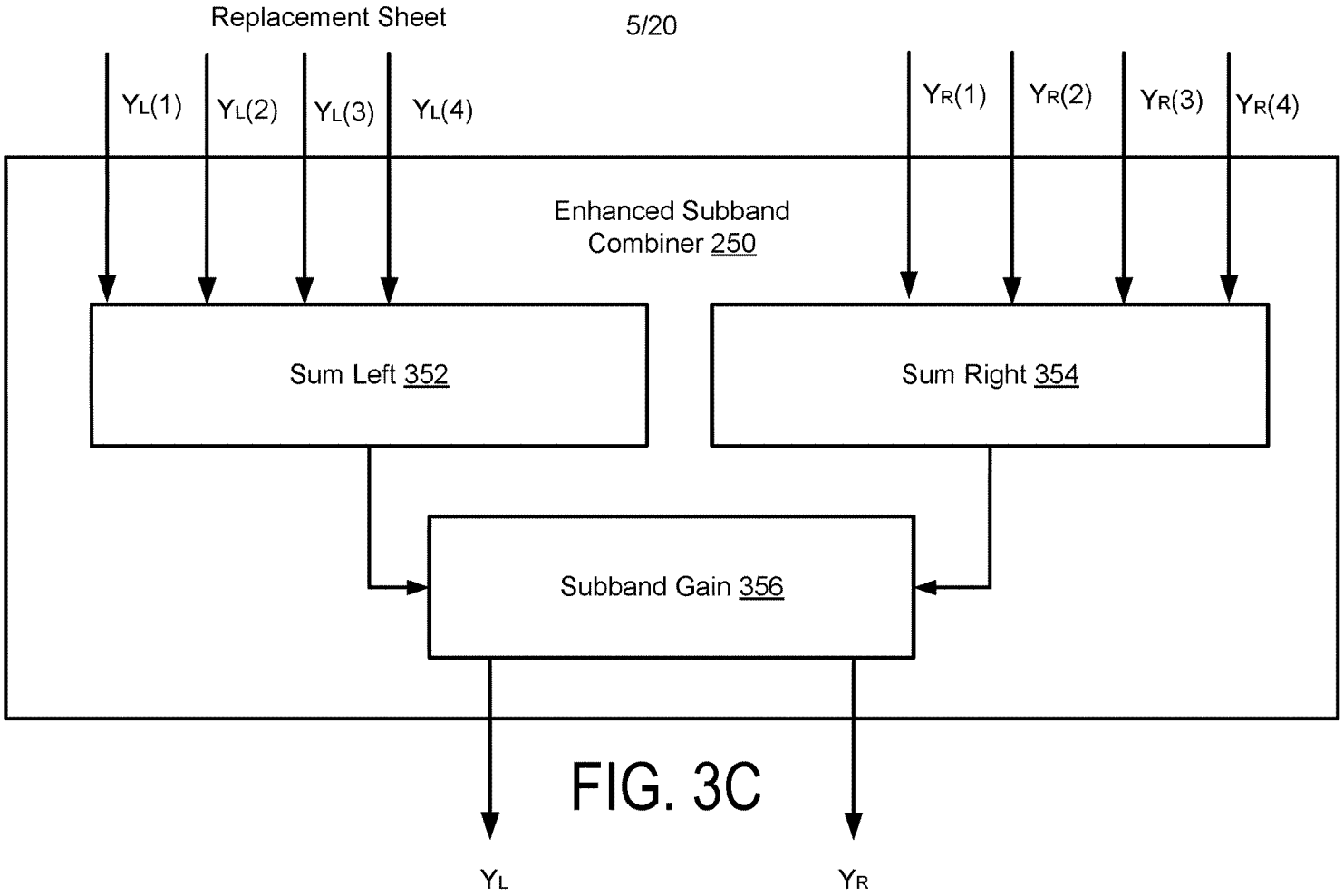
FIG. 3C illustrates an enhanced band combiner of the subband spatial enhancer, in accordance with one embodiment.

FIG. 3C illustrates the enhanced subband combiner 250 of the subband spatial enhancer 210, in accordance with one embodiment. The enhanced subband combiner 250 combines the enhanced left subband components $Y_L$(1) through $Y_L(n)$ (of frequency bands k=1 through n) from the M/S to L/R converters 340(1) through 340(*n*) to generate the left spatially enhanced audio channel $Y_L$, and combines the enhanced right subband components $Y_R$(1) through $Y_L(n)$ (of frequency bands k=1 through n) from the M/S to L/R converters 340(1) through 340(*n*) to generate the right spatially enhanced audio channel $Y_R$. The enhanced subband combiner 250 may include a sum left 352 that combines the enhanced left subband components $Y_L(k)$, a sum right 354 that combines the enhanced right subband components $Y_R(k)$, and a subband gain 356 that applies gains to the output of the sum left 352 and sum right 354. In some embodiments, the subband gain 356 applies a 0 dB gain. In some embodiments, the sum left combines enhanced left subband components $Y_L(k)$ and the sum right 354 combines the enhanced right subband components $Y_R(k)$ the according to following equations:

$$Y_L=\Sigma Y_L(k), \text{ for } k=1 \text{ to } n \quad \text{Eq. (7)}$$

$$Y_R=\Sigma Y_R(k), \text{ for } k=1 \text{ to } n \quad \text{Eq. (8)}$$

In some embodiments, the enhanced subband combiner 250 combines the subband components mid subband components $Y_m(k)$ and the side subband components $Y_s(k)$ to generate a combined mid subband component $Y_m$ and a combined side subband component $Y_s$, and then a single M/S to L/R conversion is applied per channel to generate $Y_L$ and $Y_R$ from $Y_m$ and $Y_s$. The mid/side gains are applied per subband, and can be recombined in various ways.

Figure 4:
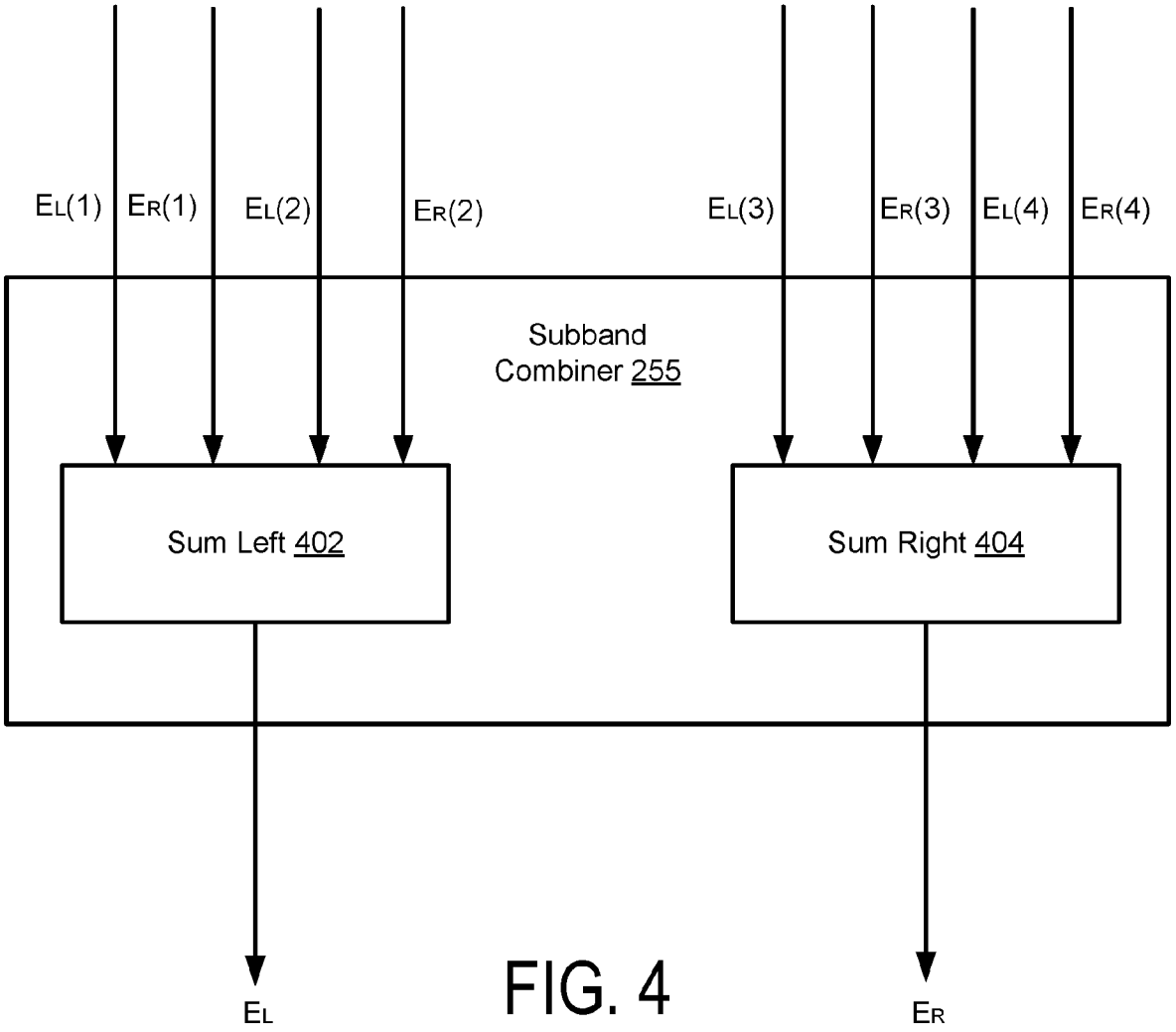
FIG. 4 illustrates a subband combiner, in accordance with one embodiment.

FIG. 4 illustrates the subband combiner 255 of the audio processing system 200, in accordance with one embodiment. The subband combiner 255 includes a sum left 402 and a sum right 404. The sum left 402 converts the left subband components $E_L$(1) through $E_L(n)$ output from the frequency band divider 240 into an subband mix left channel $E_L$. The sum right 404 combines the right subband components $E_R$(1) through $E_R(n)$ output from the frequency band divider 240 into a subband mix right channel $E_R$. The subband combiner 255 provides the subband mix left channel $E_L$ and the subband mix right channel $E_R$ to the crosstalk simulator 215, passthrough 220, and high/low frequency booster 225. In some embodiments, the original audio input channels $X_L$ and $X_R$ are provided to the crosstalk simulator 215, passthrough 220, and high/low frequency booster 225 instead of the subband mix left and right channels $E_L$ and $E_R$. Here, the subband combiner 255 can be omitted from the system 200. In another example, the subband combiner 255 may decode the subband mix left channel $E_L$ and the subband mix right channel $E_R$ from the frequency band divider 240 into the original input channels $X_L$ and $X_R$. In some embodiments, the subband combiner 255 is integrated with the crosstalk simulator 215, or some other component of the system 200.

Figure 5:
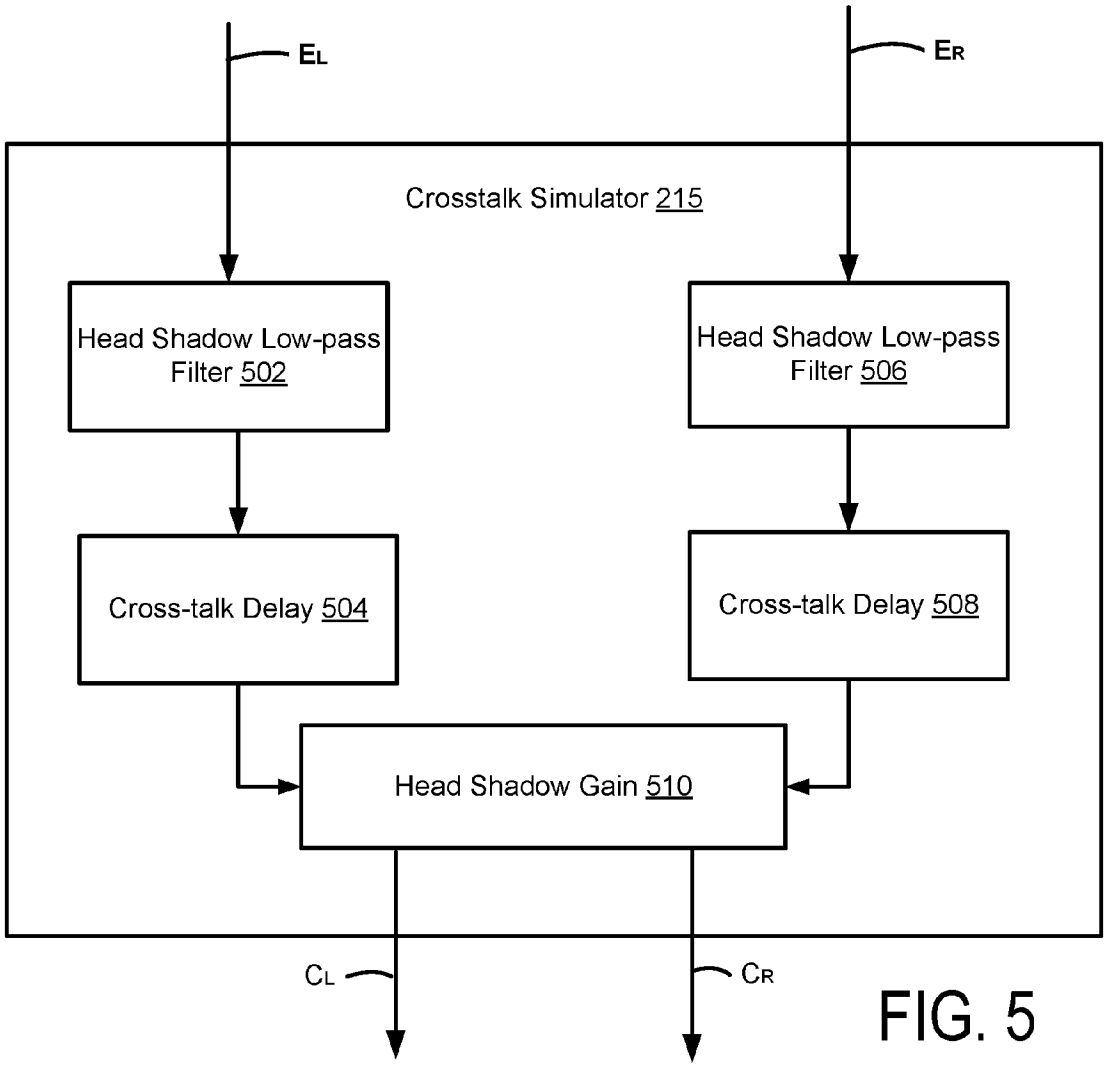
FIG. 5 illustrates a crosstalk simulator, in accordance with one embodiment.

FIG. 5 illustrates the crosstalk simulator 215 of the audio processing system 200, in accordance with one embodiment. The crosstalk simulator generates a left crosstalk channel $C_L$ and a right crosstalk channel $C_R$ from the left subband mix channel $E_L$ and the right subband mix channel $E_R$. The left crosstalk channel $C_L$ and right crosstalk channel $C_R$, when mixed with the final output signal O, incorporate simulated trans-aural sound wave propagation through the head of the listener into the output signal O. For example, the left crosstalk channel $C_L$ represents a contralateral sound component that can be mixed (e.g., by the mixer 230) with a right ipsilateral sound component (e.g., the spatially enhanced right channel $Y_R$) to generate the right output channel $O_R$. The right crosstalk channel $C_R$ represents a contralateral sound component that can be mixed with a left ipsilateral sound component (e.g., the spatially enhanced right channel $Y_L$) to generate the left output channel $O_L$.

The crosstalk simulator 215 generates contralateral sound components for output to the head-mounted speakers $\mathbf{235}_L$ and $\mathbf{235}_R$, thereby providing a loudspeaker-like listening experience on the head-mounted speakers $\mathbf{235}_L$ and $\mathbf{235}_R$. Returning to FIG. 5, the crosstalk simulator 215 includes a head shadow low-pass filter 502 and a cross-talk delay 504 to process the left subband mix channel $E_L$, a head shadow low-pass filter 506 and a cross-talk delay 508 to process the right subband mix channel $E_R$, and a head shadow gain 510 to apply gains to the output of the cross-talk delay 504 and the cross-talk delay 508. The head shadow low-pass filter 502 receives the left subband mix channel $E_L$ and applies a modulation that models the frequency response of the signal after passing through the listener's head. The output of the head shadow low-pass filter 502 is provided to the cross-talk delay 504, which applies a time delay to the output of the head shadow low-pass filter 502. The time delay represents trans-aural distance that is traversed by a contralateral sound component relative to an ipsilateral sound component. The frequency response can be generated based on empirical experiments to determine frequency dependent characteristics of sound wave modulation by the listener's head. See, e.g., J. F. Yu, Y. S. Chen, "The Head Shadow Phenomenon Affected by Sound Source: In Vitro Measurement", Applied Mechanics and Materials, Vols. 284-287, pp. 1715-1720, 2013; Areti Andreopoulou, Agnieszka Rogínska, Hariharan Mohanraj, "Analysis of the Spectral Variations in Repeated Head-Related Transfer Function Measurements," Proceedings of the 19th International Conference on Auditory Display (ICAD2013). Lodz, Poland. 6-9 Jul. 2013. International Community for Auditory Display, 2013. For example and with reference to FIG. 1, the contralateral sound component $\mathbf{112}_L$ that propagates to the right ear $\mathbf{125}_R$ can be derived from the ipsilateral sound component $\mathbf{118}_L$ that propagates to the left ear $\mathbf{125}_L$ by filtering the ipsilateral sound component $\mathbf{118}_L$ with a frequency response that represents sound wave modulation from trans-aural propagation, and a time delay that models the increased distance the contralateral sound component $\mathbf{112}_L$ travels (relative to the ipsilateral sound component $\mathbf{118}_R$) to reach the right ear $\mathbf{125}_R$. In some embodiments, the cross-talk delay 504 is applied prior to the head shadow low-pass filter 502.

Similarly for the right subband mix channel $E_R$, the head shadow low-pass filter 506 receives the right subband mix channel $E_R$ and applies a modulation that models frequency response of the listener's head. The output of the head shadow low-pass filter 506 is provided to the cross-talk delay 508, which applies a time delay to the output of the head shadow low-pass filter 504. In some embodiments, the cross-talk delay 508 is applied prior to the head shadow low-pass filter 506.

The head shadow gain 510 applies a gain to the output of the cross-talk delay 504 to generate the left crosstalk channel $C_L$, and applies a gain to the output of the cross-talk delay 506 to generate right crosstalk channel $C_R$.

In some embodiments, the head shadow low-pass filters 502 and 506 have a cutoff frequency of 2,023 Hz. The cross-talk delays 504 and 508 apply a 0.792 millisecond delay. The head shadow gain 510 applies a −14.4 dB gain.

Figure 6:
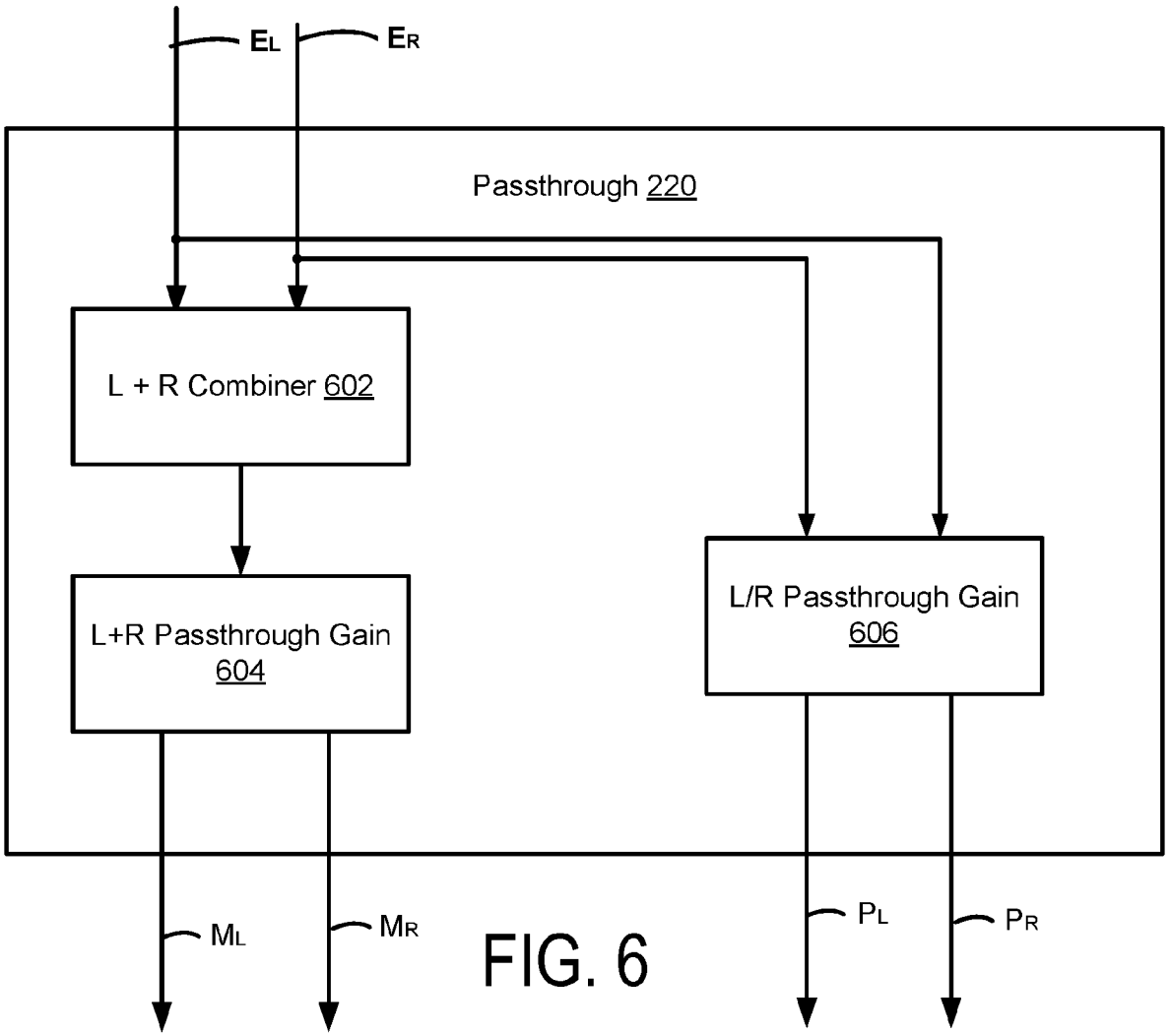
FIG. 6 illustrates a passthrough, in accordance with one embodiment.

FIG. 6 illustrates the passthrough 220 of the audio processing system 200, in accordance with one embodiment. The passthrough 220 generates a mid (L+R) channel M and a passthrough channel P from the audio input signal X. For example, the passthrough 220 generates a left mid channel $M_L$ and a right mid channel $M_R$ from the left subband mix channel $E_L$ and the right subband mix channel $E_R$, and generates a left passthrough channel $P_L$ and a right passthrough channel $P_R$ from the left subband mix channel $E_L$ and the right subband mix channel $E_R$.

The passthrough 220 includes an L+R combiner 602, an L+R passthrough gain 604, and a L/R passthrough gain 606. The L+R combiner 602 receives the left subband mix channel $E_L$ and the right subband mix channel $E_R$, and adds the left subband mix channel $E_L$ with the right subband mix channel $E_R$ to generate audio data that is common to both the left subband mix channel $E_L$ and the right subband mix channel $E_R$. The L+R passthrough gain 604 adds a gain to the output of the L+R combiner 602 to generate the left mid channel $M_L$ and the right mid channel $M_R$. The mid channels $M_L$ and $M_R$ represent the audio data that is common to both the left subband mix channel $E_L$ and the right subband mix channel $E_R$. In some embodiments, the left mid channel $M_L$ is the same as the right mid channel $M_R$. In another example, the L+R passthrough gain 604 applies different gains to the mid channel to generate a different left mid channel $M_L$ and right mid channel $M_R$.

The L/R passthrough gain 606 receives the left subband mix channel $E_L$ and the right subband mix channel $E_R$, and adds a gain to the left subband mix channel $E_L$ to generate the left passthrough channel $P_L$, and adds a gain to the right subband mix channel $E_R$ to generate the right passthrough channel $P_R$. In some embodiments, a first gain is applied to the left subband mix channel $E_L$ to generate the left passthrough channel $P_L$ and a second gain is applied to the right subband mix channel $E_R$ to generate the right passthrough channel $P_R$, where the first and second gains are different. In some embodiments, the first and second gains are the same.

In some embodiments, the passthrough 220 receives and processes the original audio input signals $X_L$ and $X_R$. Here, the mid channel M represents audio data that is common to both the left and right input signal $X_L$ and $X_R$, and the passthrough channel P represents the original audio signal X (e.g., without encoding into frequency subbands by frequency band divider 240, and recombination by the subband band combiner 255 into the left subband mix channel $E_L$ and the right subband mix channel $E_R$).

In some embodiments, the L+R passthrough gain 604 applies a −18 dB gain to the output of the L+R combiner 602. The L/R passthrough gain 606 applies an −infinity dB gain to the left subband mix channel $E_L$ and the right subband mix channel $E_R$.

Figure 7:
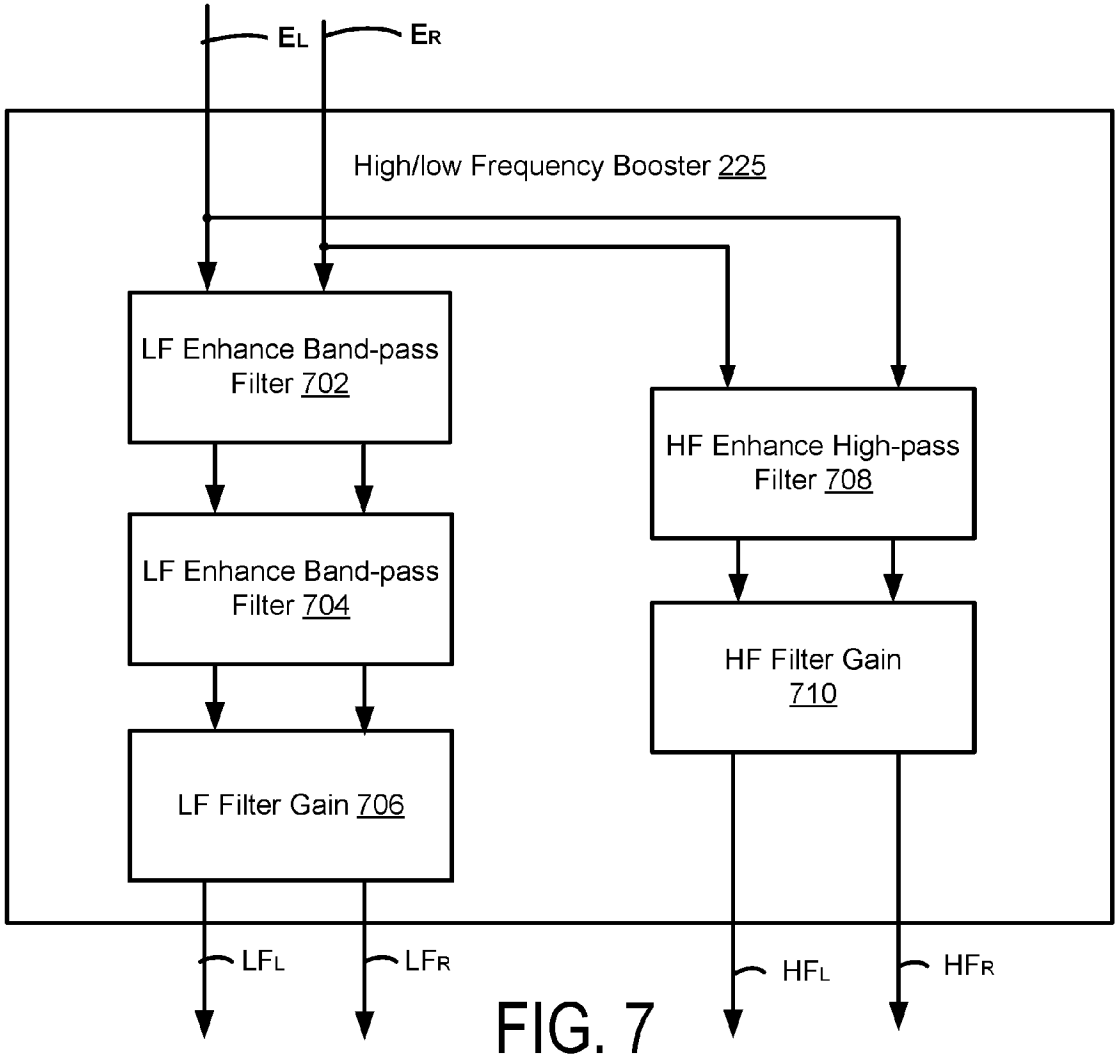
FIG. 7 illustrates a high/low frequency booster, in accordance with one embodiment.

FIG. 7 illustrates the high/low frequency booster 225 of the audio processing system 200, in accordance with one embodiment. The high/low frequency booster 225 generates low frequency channels $LF_L$ and $LF_R$, and high frequency channels $HF_L$ and $HF_R$ from the left subband mix channel $E_L$ and the right subband mix channel $E_R$. The low and high frequency channels represent frequency dependent enhancements to the audio input signal X.

The high/low frequency booster 225 includes a first low frequency (LF) enhance band-pass filter 702, a second LF enhance band-pass filter 704, a LF filter gain 705, a high frequency (HF) enhance high-pass filter 708 and a HF filter gain 710. The LF enhance band-pass filter 702 receives the left subband mix channel $E_L$ and the right subband mix channel $E_R$, and applies a modulation that attenuates signal components outside of a band or spread of frequencies, thereby allowing (e.g., low frequency) signal components inside the band of frequencies to pass. The LF enhance band-pass filter 704 receives the output of the LF enhance band-pass filter 704, and applies another modulation that attenuates signal components outside of the band of frequencies.

The LF enhance band-pass filter 702 and LF enhance band-pass filter 704 provide a cascaded resonator for low frequency enhancement. In some embodiments, the LF enhance band-pass filters 702 and 704 have a center frequency of 58.175 Hz with an adjustable quality (Q) factor.

The Q factor can be adjusted based on user setting or programmatic configuration. For example, a default setting may include a Q factor of 2.5, while a more aggressive setting may include a Q factor of 1.3. The resonators are configured to exhibit an under-damped response (Q>0.5) to enhance the temporal envelope of low frequency content.

The LF filter gain 706 applies a gain to the output of the LF enhance band-pass filter 704 to generate the left LF channel $LF_L$ and the right LF channel $LF_R$. In some embodiments, the LF filter gain 706 applies a 12 dB gain to the output of the LF enhance band-pass filter 704.

HF enhance high-pass filter 708 receives the left subband mix channel $E_L$ and the right subband mix channel $E_R$, and applies a modulation that attenuates signal components with frequencies lower than a cutoff frequency, thereby allowing signal components with frequencies higher than the cutoff frequency to pass. In some embodiments, the HF enhance high-pass filter 708 is a second order Butterworth highpass filter with a cutoff frequency of 4573 Hz.

The HF filter gain 710 applies a gain to the output of the HF enhance high-pass filter 704 to generate the left HF channel $HF_L$ and the right HF channel $HF_R$. In some embodiments, the HF filter gain 710 applies a 0 dB gain to the output of the HF enhance high-pass filter 708.

Figure 8:
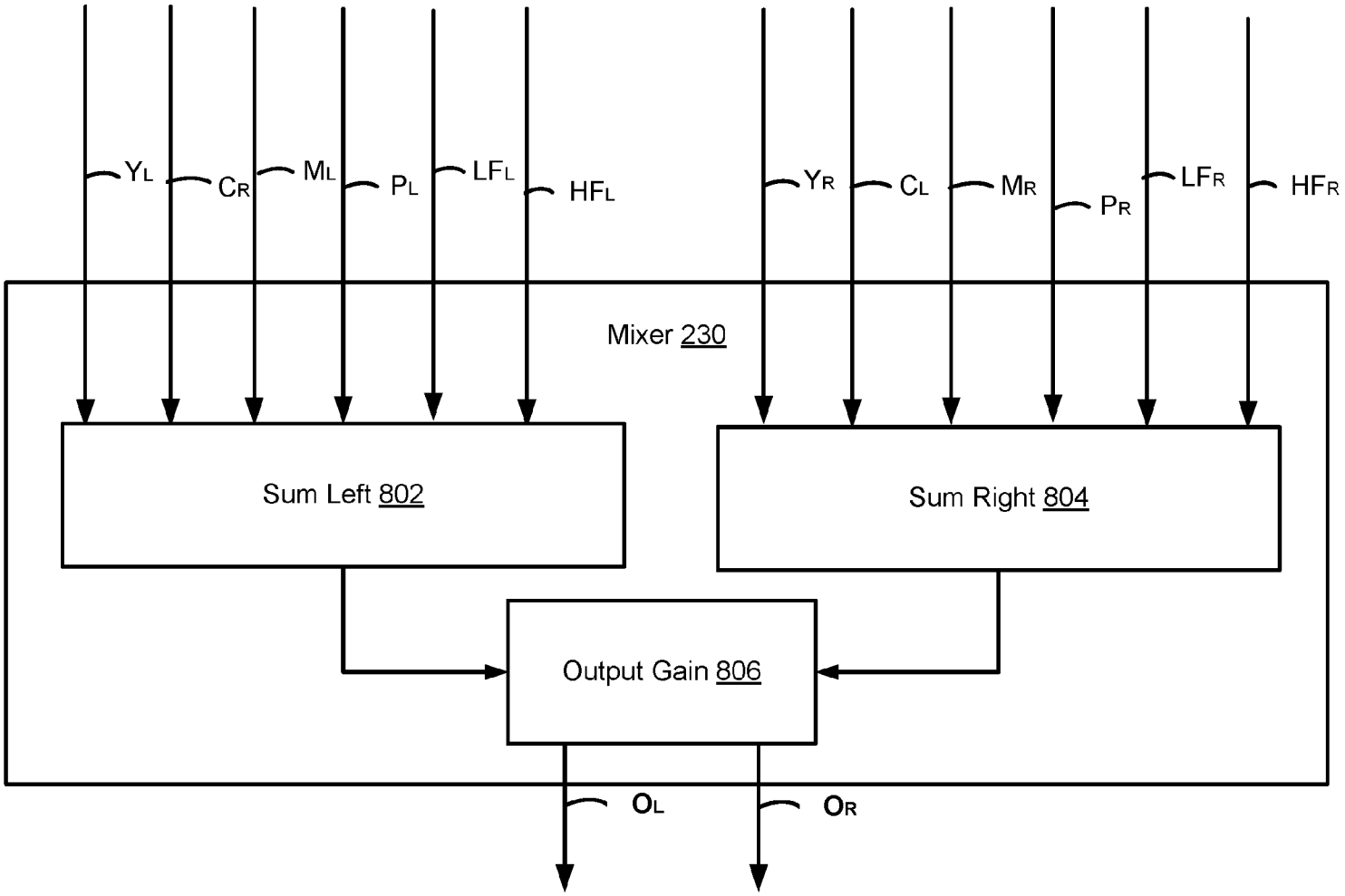
FIG. 8 illustrates a mixer, in accordance with one embodiment.

FIG. 8 illustrates the mixer 230 of the audio processing system 200, in accordance with one embodiment. The mixer 230 generates the output channels $O_L$ and $O_R$ based on weighted combinations of outputs from the subband spatial enhancer 210, the crosstalk simulator 215, the passthrough 220, and the high/low frequency booster 225. The mixer 230 provides the left output channel $O_L$ to the left speaker $\mathbf{235}_L$ and the right output signal $O_R$ to the right speaker $\mathbf{235}_R$ Mixer 230 includes a sum left 802, a sum right 804, and an output gain 806. The sum left 802 receives the spatially enhanced left channel $Y_L$ from the subband spatial enhancer 210, the right crosstalk channel $C_R$ from the crosstalk simulator 215, the left mid channel $M_L$ and the left passthrough channel $P_L$ from the passthrough 220, and the left low and high frequency channels $LF_L$ and $HF_L$ from the high/low frequency booster 225, and the sum left 802 combines these channels. Similarly, the sum right 804 receives the spatially enhanced left channel $Y_R$ from the subband spatial enhancer 210, the left crosstalk channel $C_L$ from the crosstalk simulator 215, the right mid channel $M_R$ and the right passthrough channel $P_R$ from the passthrough 220, and the right low and high frequency channels $LF_R$ and $HF_R$ from the high/low frequency booster 225, and the sum right 804 combines these channels.

The output gain 806 applies a gain to the output of the sum left 802 to generate the left output channel $O_L$, and applies a gain to the output of the sum right 804 to generate the right output channel $O_R$. In some embodiments, the output gain 806 applies a 0 dB gain to the output of the sum left 802 and the sum right 804. In some embodiments, the subband gain 356, the head shadow gain 510, the L+R passthrough gain 604, the L/R passthrough gain 606, the LF filter gain 706, and/or the HF filter gain 710 are integrated with the mixer 230. Here, the mixer 230 controls the relative weightings of input channel contribution to the output channels $O_L$ and $O_R$.

Figure 9:
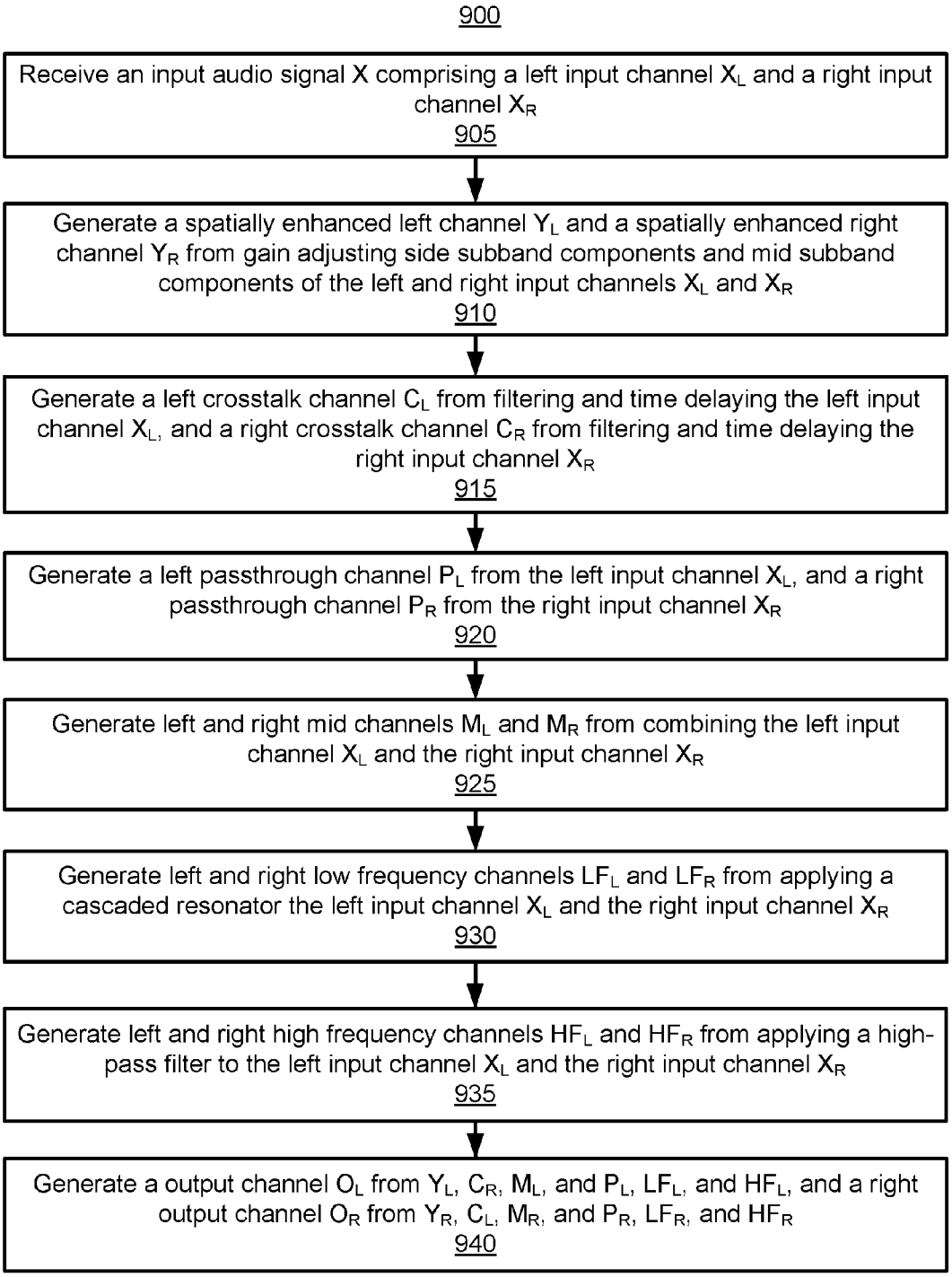
FIG. 9 illustrates an example method of optimizing an audio signal for head-mounted speakers, in accordance with one embodiment.

FIG. 9 illustrates a method 900 of optimizing an audio signal for head-mounted speakers, in accordance with one embodiment. The audio processing system 200 may perform the steps in parallel, perform the steps in different orders, or perform different steps.

The system 200 receives 905 an input audio signal X comprising a left input channel $X_L$ and a right input channel $X_R$. The audio input signal X may be a stereo signal where the left and right input channels $X_L$ and $X_R$ are different from each other.

The system 200, such as the subband spatial enhancer 210, generates 910 a spatially enhanced left channel $Y_L$ and a spatially enhanced right channel $Y_R$ from gain adjusting side subband components and mid subband components of the left and right input channels $X_L$ and $X_R$. The spatially enhanced left and right channels $Y_L$ and $Y_R$ improve the spatial sense in the sound field by altering intensity ratios between mid and side subband components derived from the left and right input channels $X_L$ and $X_R$, as discussed in greater detail below in connection with FIG. 10.

The system 200, such as the crosstalk simulator 215, generates 915 a left crosstalk channel $C_L$ from filtering and time delaying the left input channel $X_L$, and a right crosstalk channel $C_R$ from filtering and time delaying the right input channel $X_R$. The crosstalk channels $C_L$ and $C_R$ simulate trans-aural, contralateral crosstalk for the left input channel $X_L$ and the right input channel $X_R$ that would reach the listener if the left input channel $X_L$ and the right input channel $X_R$ were output from loudspeakers, such as shown in FIG. 1. Generating the crosstalk channels is discussed in greater detail below in connection with FIG. 11.

The system 200, such as the passthrough 220, generates 920 a left passthrough channel $P_L$ from the left input channel $X_L$, a right passthrough channel $P_R$ from the right input channel $X_R$. The system 200, such as the passthrough 220, generates 925 left and right mid channels $M_L$ and $M_R$ from combining the left input channel $X_L$ and the right input channel $X_R$. The passthrough channels can be used to control the relative contributions of the unprocessed input channel X to the output channel O, and the mid channels can be used to control the relative contribution of common audio data of the left input channel $X_L$ and the right input channel $X_R$. Generating the passthrough and mid channels is discussed in greater detail below in connection with FIG. 12.

The system 200, such as the high/low frequency booster 225 generates 930 left and right low frequency channels $LF_L$ and $LF_R$ from applying a cascaded resonator to the left input channel $X_L$ and the right input channel $X_R$. The low frequency channels $LF_L$ and $LF_R$ control the relative enhancement of low frequency audio components of the input channel X to the output channel O.

The system 200, such as the high/low frequency booster 255 generates 935 left and right high frequency channels $HF_L$ and $HF_R$ from applying a high-pass filter to the left input channel $X_L$ and the right input channel $X_R$. The high frequency channels $HF_L$ and $HF_R$ control the relative enhancement of high frequency audio components of the input channel X to the output channel O. Generating the LF and HF channels is discussed in greater detail below in connection with FIG. 13.

The system 200, such as the mixer 230, generates 940 the output channel $O_L$ and the output channel $O_R$. The output channel $O_L$ can be provided to a head-mounted left speaker $\mathbf{235}_L$ and the right output channel $O_R$ is provided to a right speaker $\mathbf{235}_R$. The output channel $O_L$ is generated from a weighted combination of the spatially enhanced left channel $Y_L$ from the subband spatial enhancer 210, the right crosstalk channel $C_R$ from the crosstalk simulator 215, the left mid channel $M_L$ and the left passthrough channel $P_L$ from the passthrough 220, and the left low and high frequency channels $LF_L$ and $HF_L$ from the high/low frequency booster 225. The output channel $O_R$ is generated from a weighted combination the spatially enhanced left channel $Y_R$ from the subband spatial enhancer 210, the left crosstalk channel $C_L$ from the crosstalk simulator 215, the right mid channel $M_R$ and the right passthrough channel $P_R$ from the passthrough 220, and the right low and high frequency channels $LF_R$ and $HF_R$ from the high/low frequency booster 225.

The relative weightings of the inputs to the mixer 230 can be controlled by the gain filters at the channel sources as discussed above, such as the input gain 302, the subband gain 356, the head shadow gain 510, the L+R passthrough gain 604, the L/R passthrough gain 606, the LF filter gain 706, and the HF filter gain 710. For example, a gain filter can lower a signal amplitude of a channel to lower the contribution of the channel to the output channel O, or increase the signal amplitude to increase the contribution of the channel to the output channel O. In some embodiments, the signal amplitudes of one or more channels may be set to 0 or substantially 0, resulting in no contribution of the one or more channels to the output channel O.

In some embodiments, the subband gain 356 applies between a −12 to 6 dB gain, the head shadow gain 510 applies a −infinity to 0 dB gain, the LF filter gain 706 applies a 0 to 20 dB gain, the HF filter gain 710 applies a 0 to 20 dB gain, the L/R passthrough gain 606 applies a −infinity to 0 dB gain, and the L+R passthrough gain 604 applies a −infinity to 0 dB gain. The relative values of the gains may be adjustable to provide different tunings. In some embodiments, the audio processing system uses predefined sets of gain values. For example, the subband gain 356 applies 0 dB gain, the head shadow gain 510 applies a −14.4 dB gain, the LF filter gain 706 applies between a 12 dB gain, the HF filter gain 710 applies a 0 dB gain, the L/R passthrough gain 606 applies −infinity dB gain, and the L+R passthrough gain 604 applies a −18 dB gain.

As discussed above, the steps in method 900 may be performed in different orders. In one example, steps 910 through 935 are performed in parallel such that the input channels Y, C, M, LF, and HF are available to the mixer 230 at substantially the same time for combination.

Figure 10:
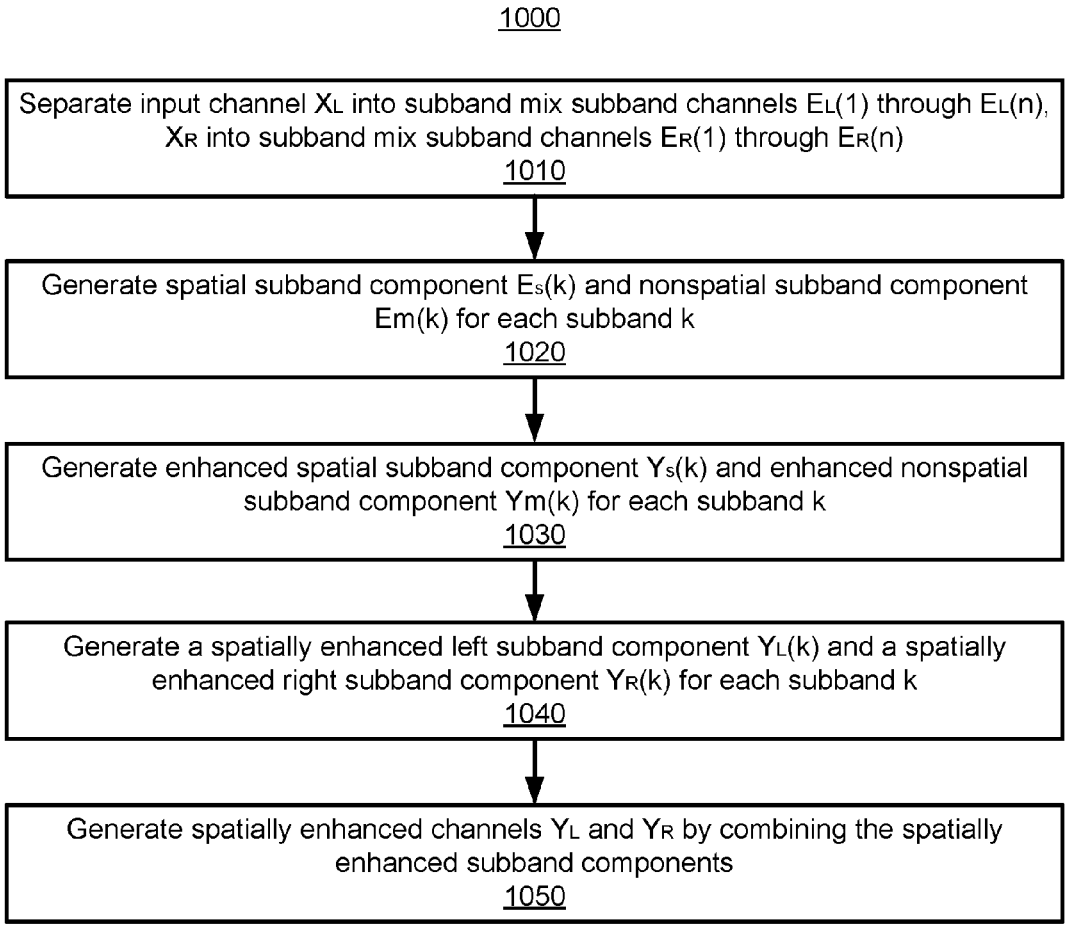
FIG. 10 illustrates a method of generating spatially enhanced channels from an input audio signal, in accordance with one embodiment.

FIG. 10 illustrates a method 1000 of generating spatially enhanced channels $Y_L$ and $Y_R$ from an input audio signal X, in accordance with one embodiment. Method 1000 may be performed at 910 of method 900, such as by the subband spatial enhancer 210 of the system 200.

The subband spatial enhancer 210, such as the crossover network 304 of the frequency band divider 240, separates 1010 the input channel $X_L$ into subband mix subband channels $E_L(\mathbf{1})$ through $E_L(n)$, and separates the input channel $X_R$ into subband mix subband channels $E_R(\mathbf{1})$ through $E_R(n)$. N is a predefined number of subband channels, and in some embodiments, is four subband channels corresponding to 0 to 300 Hz, 300 to 510 Hz, 510 to 2700 Hz, and 2700 Hz to Nyquist frequency respectively. As discussed above, the n subband channels approximate critical bands of the human year. The n subband channels are a set of consolidated critical bands determined by using a corpus of audio samples from a wide variety of musical genres, and determining from the samples a long term average energy ratio of mid to side components over 24 Bark scale critical bands. Contiguous frequency bands with similar long term average ratios are then grouped together to form the set of n critical bands.

The subband spatial enhancer 210, such as the L/R to M/S converters 320(*k*) of the frequency band enhancer 245, generates 1020 spatial subband component $E_s(k)$ and nonspatial subband component $E_m(k)$ for each subband k (where k=1 through n). For example, each L/R to M/S converter 320(*k*) receives a pair of subband mix subband components $E_L(k)$ and $E_R(k)$, and converts these inputs into a mid subband component $E_m(k)$ and a side subband component $E_s(k)$ according to Eqs. (1) and (2) discussed above. For n=4, the L/R to M/S converters 320(1) through 320(4) generate spatial subband components $E_s(\mathbf{1})$, $E_s(\mathbf{2})$, $E_s(\mathbf{3})$, and $E_s(\mathbf{4})$, and nonspatial subband component $E_m(\mathbf{1})$, $E_m(\mathbf{2})$, $E_m(\mathbf{3})$, and $E_m(\mathbf{4})$.

The subband spatial enhancer 210, such as the mid/side processors 330(*k*) of the frequency band enhancer 245, generates 1030 an enhanced spatial subband component $Y_s(k)$ and an enhanced nonspatial subband component $Y_m(k)$ for each subband k. For example, each mid/side processors 330(*k*) converts a mid subband component $E_m(k)$ into an enhanced spatial subband component $Y_m(k)$ by applying a gain $G_m(k)$ and a delay function D according to Eq. (3). Each mid/side processors 330(*k*) converts a side subband component $E_s(k)$ into an enhanced spatial subband component $Y_s(k)$ by applying a gain $G_s(k)$ and a delay function D according to Eq. (4).

In some embodiments, the values of the gains $G_m(k)$ and $G_s(k)$ for each subband k is initially determined based on sampling long term average energy ratio of mid to side components over the subband k from a corpus of audio samples, such as from a wide variety of musical genres. In some embodiments, the audio samples may include different types of audio content such as movies, movies, and games. In another example, the sampling can be performed using audio samples known to include desirable spatial properties. These mid to side energy ratios are used as a point of departure in calculating the gains of $G_m$ and $G_s$ for the mid subband component $Y_m(k)$ and the enhanced side subband component $Y_s(k)$. Final subband gains are then defined through expert subjective listening tests across a wide body of audio samples, as described above. In some embodiments, the gains $G_m$ and $G_s$, and delays $D_m$ and $D_s$, may be determined according to speaker parameters or may be fixed for an assumed set of parameter values.

The subband spatial enhancer 210, such as the M/S to L/R converters 340(*k*) of the frequency band enhancer 245, generates 1040 a spatially enhanced left subband component $Y_L(k)$ and a spatially enhanced right subband component $Y_R(k)$ for each subband k. Each M/S to L/R converter 340(*k*) receives an enhanced mid component $Y_m(k)$ and an enhanced side component $Y_s(k)$, and converts them into the spatially enhanced left subband component $Y_L(k)$ and the spatially enhanced right subband component $Y_R(k)$, such as according to Eqs. (5) and (6). Here, the spatially enhanced left subband component $Y_L(k)$ is generated based on adding the enhanced mid component $Y_m(k)$ and the enhanced side component $Y_s(k)$, and the spatially enhanced right subband component $Y_R(k)$ is generated based on subtracting the enhanced side component $Y_s(k)$ from the enhanced mid component $Y_m(k)$. For n=4 subbands, the M/S to L/R converters 340(1) through 340(4) generate enhanced left subband components $Y_L(\mathbf{1})$ through $Y_L(\mathbf{4})$, and enhanced right subband component $Y_R(\mathbf{1})$ through $Y_R(\mathbf{4})$.

The subband spatial enhancer 210, such as the enhanced subband combiner 250, generates 1050 a spatially enhanced left channel $Y_L$ by combining the enhanced left subband components $Y_L(\mathbf{1})$ through $Y_L(n)$, and a spatially enhanced right channel $Y_R$ by combining the enhanced right subband components $Y_R(\mathbf{1})$ through $Y_R(n)$. The combinations may be performed based on Eqs. 5 and 6 as discussed above. In some embodiments, the enhanced subband combiner 250 may further apply a subband gain to the spatially enhanced left channel $Y_L$ and spatially enhanced left channel $Y_R$ that controls the contribution of the spatially enhanced left channel $Y_L$ to the left output channel $O_L$, and the contribution of the spatially enhanced right channel $Y_R$ to the right output channel $O_R$. In some embodiments, the subband gain is a 0 dB gain to serve as a baseline level, with the other gains discussed herein being set relative to the 0 dB gain. In some embodiments, such as when the input gain 302 is different from the −2 dB gain, the subband gain can be adjusted accordingly (e.g., to reach a desired baseline level for the spatially enhanced left channel $Y_L$ and spatially enhanced left channel $Y_R$).

In various embodiments, the steps in method 1000 may be performed in different orders. For example, the enhanced spatial subband components $Y_s(k)$ for the subbands k=1 through n may be combined to generate $Y_s$, and the enhanced nonspatial subband component $Y_{in}(k)$ for the subbands k=1 through n may be combined to generate $Y_m$. The $Y_s$ and $Y_m$ may be converted into the spatially enhanced channels $Y_L$ and $Y_R$ using M/S to L/R conversion.

Figure 11:
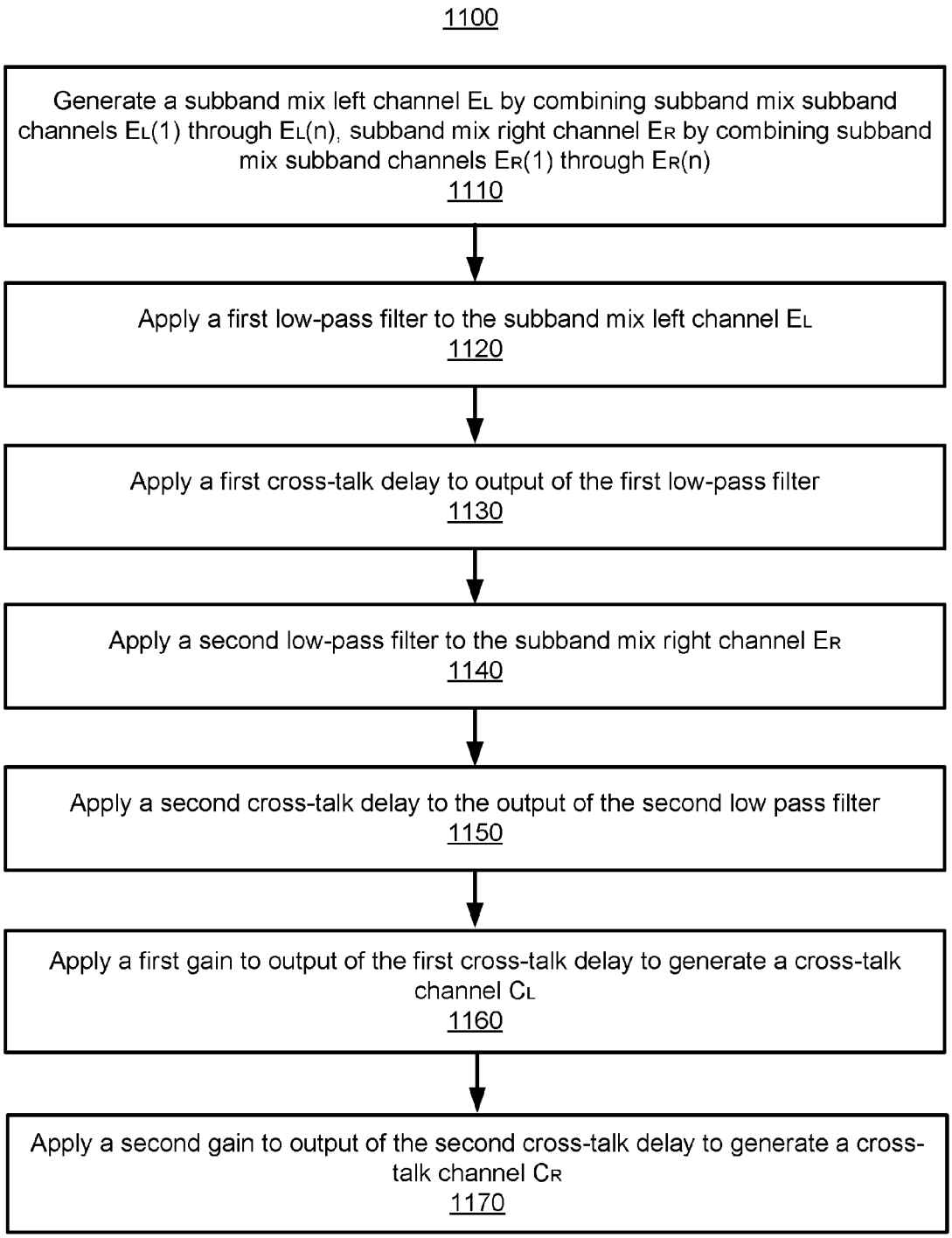
FIG. 11 illustrates a method of generating cross-talk channels from the audio input signal, in accordance with one embodiment.

FIG. 11 illustrates a method 1100 of generating cross-talk channels from the audio input signal, in accordance with one embodiment. Method 1100 may be performed at 915 of method 900. The cross-talk channels $C_L$ and $C_R$, which represent contralateral crosstalk signals, are generated based on applying a filter and a time delay to the ipsilateral input channels $X_L$ and $X_R$.

The subband band combiner 255 of the system 200 generates 1110 a subband mix left channel $E_L$ by combining subband mix subband channels $E_L(1)$ through $E_L(n)$, and a subband mix right channel $E_R$ by combining subband mix subband channels $E_R(1)$ through $E_R(n)$. The left subband mix channel $E_L$ and right subband mix channel $E_R$ are used as inputs for the crosstalk simulator 215, the passthrough 220, and/or the high/low frequency booster 225. In some embodiments, the crosstalk simulator 215, the passthrough 220, and/or the high/low frequency booster 225 may receive and process the original audio input channels $X_L$ and $X_R$ instead of the subband mix channels $E_L$ and $E_R$. Here, step 1100 is not performed, and the subsequent processing steps of method 1100 are performed using the audio input channels $X_L$ and $X_R$. In some embodiments, the subband band combiner 255 decodes the subband mix left subband channels $E_L(1)$ through $E_L(n)$ into the left input channel $X_L$, and decodes the subband mix right subband channels $E_R(1)$ through $E_R(n)$ into the right input channel $X_R$.

The crosstalk simulator 215 of the system 200 applies 1120 a first low-pass filter to the subband mix left channel $E_L$. The first low-pass filter may be the head shadow low-pass filter 502 of the crosstalk simulator 215, which applies a modulation that models the frequency response of the signal after passing through the listener's head. As discussed above, the head shadow low-pass filter 502 may have a cutoff frequency of 2,023 Hz, where frequency components of the subband mix left channel $E_L$ that exceed the cutoff frequency are attenuated. Other embodiments of the crosstalk simulator 215 of the system 200 may employ a low-shelf or notch filter for the head shadow low-pass filter. This filter may have a cutoff/center frequency of 2023 Hz, with a Q of between 0.5 and 1.0 and a gain of between −6 and −24 dB.

The crosstalk simulator 215 applies 1130 a first cross-talk delay to output of the first low-pass filter. For example, the cross-delay 504 provides a time delay that models the increased trans-aural distance (and thus increased traveling time) that a contralateral sound component $\mathbf{112}_L$ from the left loudspeaker 110A travels relative to the ipsilateral sound component $\mathbf{118}_R$ from the right loudspeaker 110B to reach the right ear $\mathbf{125}_R$ of the listener 120, as shown in FIG. 1. In some embodiments, the cross-delay 504 applies a 0.792 millisecond cross-talk delay to the filtered subband mix left channel $E_L$. In some embodiments, steps 1120 and 1130 are reversed such that the first cross-talk delay is applied prior to the first low-pass filter.

The crosstalk simulator 215 applies 1140 a second low-pass filter to the subband mix right channel $E_R$. The second low-pass filter may be the head shadow low-pass filter 506 of the crosstalk simulator 215, which applies a modulation that models the frequency response of the signal after passing through the listener's head. In some embodiments, the head shadow low-pass filter 506 may have a cutoff frequency of 2,023 Hz, where frequency components of the subband mix right channel $E_R$ that exceed the cutoff frequency are attenuated. Another embodiment of the crosstalk simulator 215 of the system 200 may employ a low-shelf or notch filter for the head shadow low-pass filter. This filter may have a cutoff frequency of 2023 Hz, with a Q of between 0.5 and 1.0 and a gain of between −6 and −24 dB.

The crosstalk simulator 215 applies 1150 a second cross-talk delay to output of the second low-pass filter. The second time delay models the increased trans-aural distance that a contralateral sound component $\mathbf{112}_R$ from the right loudspeaker 110B travels relative to the ipsilateral sound component $\mathbf{118}_L$ from the left loudspeaker 110B to reach the left ear $\mathbf{125}_L$ of the listener 120, as shown in FIG. 1. In some embodiments, the cross-delay 508 applies a 0.792 millisecond cross-talk delay to the filtered subband mix left channel $E_R$. In some embodiments, steps 1140 and 1150 are reversed such that the second cross-talk delay is applied prior to the second low-pass filter.

The cross talk simulator 215 applies 1160 a first gain to the output of the first cross-talk delay to generate a left cross-talk channel $C_L$. The crosstalk simulator 215 applies 1170 a second gain to the output of the second cross-talk delay to generate a right cross-talk channel $C_R$. In some embodiments, the head shadow gain 510 applies a −14.4 dB gain to generate the left cross-talk channel $C_L$ and right cross-talk channel $C_R$.

In various embodiments, the steps in method 1100 may be performed in different orders. For example, steps 1120 and 1130 may be performed in parallel with steps 1140 and 1150 to process the left and right channels in parallel, and generate the left cross-talk channel $C_L$ and right cross-talk channel $C_R$ in parallel.

Figure 12:
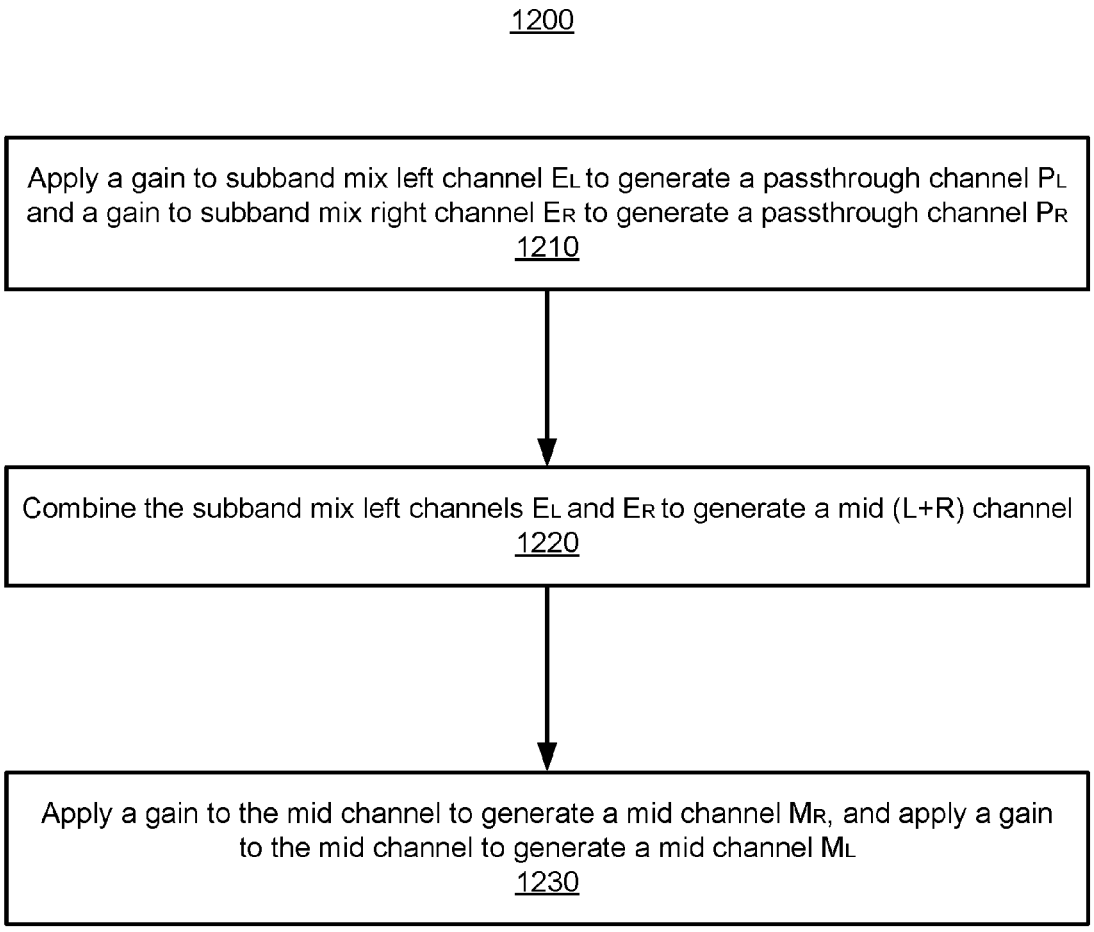
FIG. 12 illustrates a method of generating left and right passthrough channels and mid channels from the audio input signal, in accordance with one embodiment.

FIG. 12 illustrates a method 1200 of generating left and right passthrough channels and mid channels from the audio input signal, in accordance with one embodiment. Method 1200 may be performed at 920 and 925 of method 900. The passthrough channel controls the contribution of the non-spatially enhanced input channel X to the output channel O, and the mid channel controls the contribution of common audio data of the non-spatially enhanced left input channel $X_L$ and the non-spatially right input channel $X_R$ to the output channel O.

The passthrough 220 of the audio processing system 200 applies 1210 a gain to the subband mix left channel $E_L$ to generate a passthrough channel $P_L$, and a gain to the subband mix right channel $E_R$ to generate a passthrough channel $P_R$. In some embodiments, L/R passthrough gain 606 of the passthrough 220 applies an −infinity dB gain to the left subband mix channel $E_L$ and the right subband mix channel $E_R$. Here, the passthrough channels $P_L$ and $P_R$ are fully attenuated and do not contribute to the output signal O. The level of gain can be adjusted to control the amount of the non-spatially enhanced input signal that contributes to the output signal O.

The passthrough 220 combines 1230 the subband mix left channel $E_L$ and the subband mix right channel ER to generate a mid (L+R) channel. For example, the L+R combiner 602 of the passthrough 220 adds the left subband mix channel $E_L$ with the right subband mix channel $E_R$ to a channel having audio data that is common to both the left subband mix channel $E_L$ and the right subband mix channel $E_R$.

The passthrough 220 applies 1240 a gain to the mid channel to generate a left mid channel $M_L$, and a gain to the mid channel to generate a right mid channel $M_R$. In some embodiments, the L+R passthrough gain 604 applies a −18 dB gain to the output of the L+R combiner 602 to generate the left and right mid channels $M_L$ and $M_R$. The level of gain can be adjusted to control the amount of the non-spatially enhanced mid input signal that contributes to the output signal O. In some embodiments, a single gain is applied to the mid channel, and the gain-applied mid channel is used for the left and right mid channels $M_L$ and $M_R$.

In various embodiments, the steps in method 1200 may be performed in different orders. For example, steps 1210 and 1230 may be performed in parallel to generate the passthrough channels and mid channel in parallel.

Figure 13:
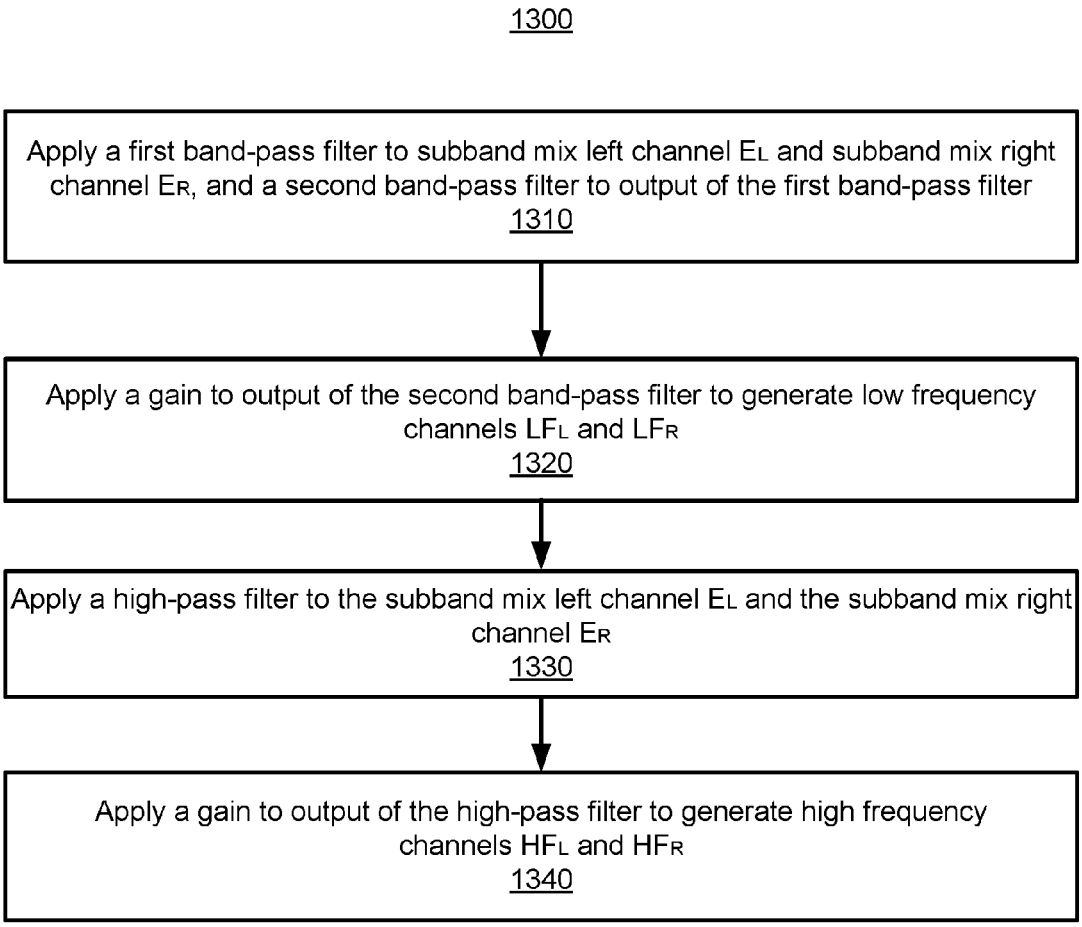
FIG. 13 illustrates a method of generating low and high frequency enhancement channels from the audio input signal, in accordance with one embodiment.

FIG. 13 illustrates a method 1300 of generating low and high frequency enhancement channels from the audio input signal, in accordance with one embodiment. Method 1300 may be performed at 930 and 935 of method 900. The LF enhancement channels control the contribution of low frequency components of the non-spatially enhanced input channel X to the output channel O. The HF enhancement channels control the contribution of high frequency components of the non-spatially enhanced input channel X to the output channel O.

The high/low frequency booster 225 of the audio processing system 200 applies 1310 a first band-pass filter to subband mix left channel $E_L$ and subband mix right channel $E_R$, and a second band-pass filter to output of the first band-pass filter. For example, the LF enhance band-pass filter 702 and LF enhance band-pass filter 704 provide a cascaded resonator for low frequency enhancement. The characteristics of the first and second band-pass filters may be adjustable, such as different settings with predefined Q factor and/or center frequency of the band-pass filters. In some embodiments, the center frequency is set to a predefined level (e.g., 58.175 Hz), and the Q factor is adjustable. In some embodiments, a user can select from a predefined set of settings for the band-pass filters. The cascaded band-pass filter system selectively enhances energy in the signal that would typically be handled via a separate subwoofer in an in field loudspeaker system, but which is often not sufficiently represented when rendered over head-mounted speakers (i.e. headphones). The fourth order filter design (i.e. two cascaded second order band-pass filters) exhibits a crisp temporal response when excited, adding a "punch" to key low frequency elements within the mix such as bass drum and bass guitar attacks, while avoiding an overall "muddiness" that may occur if simply increasing low frequency energy over a wider band in the low frequency spectrum using a second order band-pass, low-shelf, or peaking filter.

The high/low frequency booster 225 applies 1320 a gain to output of the second band-pass filter to generate low frequency channels $LF_L$ and $LF_R$. For example, the LF filter gain 706 applies a gain to the output of the LF enhance band-pass filter 704 to generate the left LF channel $LF_L$ and the right LF channel $LF_R$. The LF filter gain 706 controls the contribution of the low frequency channels $LF_L$ and $LF_R$ to the audio output channels $O_L$ and $O_R$.

The high/low frequency booster 225 applies 1330 a high-pass filter to the subband mix left channel $E_L$ and subband mix right channel $E_R$. For example, the HF enhance high-pass filter 708 applies a modulation that attenuates signal components with frequencies lower than a cutoff frequency of the HF enhance high-pass filter 708. As discussed above, the HF enhance high-pass filter 708 may be a second order Butterworth filter with a cutoff frequency of 4573 Hz. In some embodiments, the characteristics of the high-pass filter are adjustable, such as different settings of the cutoff frequency and gain are applied to the output of the high-pass filter. The overall high frequency amplification achieved through the addition of this high-pass filter serves to accentuate impactful timbral, spectral, and temporal information within typical musical signals (e.g. high frequency percussion such as cymbals, high frequency elements of acoustic room responses, etc). Furthermore, said enhancement serves to increase the perceived effectiveness of spatial signal enhancement, while avoiding undue coloration in low and mid frequency non-spatial signal elements (commonly vocals and bass guitar).

The high/low frequency booster 225 applies 1340 a gain to output of the high-pass filter to generate high frequency channels $HF_L$ and $HF_R$. The level of gain can be adjusted to control the contribution of the high frequency channels $HF_L$ and $HF_R$ to the audio output channels $O_L$ and $O_R$. In some embodiments, the HF filter gain 710 applies a 0 dB gain to the output of the HF enhance high-pass filter 708.

In various embodiments, the steps in method 1300 may be performed in different orders. For example, steps 1310 and 1330 may be performed in parallel with steps 1330 and 1340 to generate the low and high frequency channels in parallel.

Figure 14:
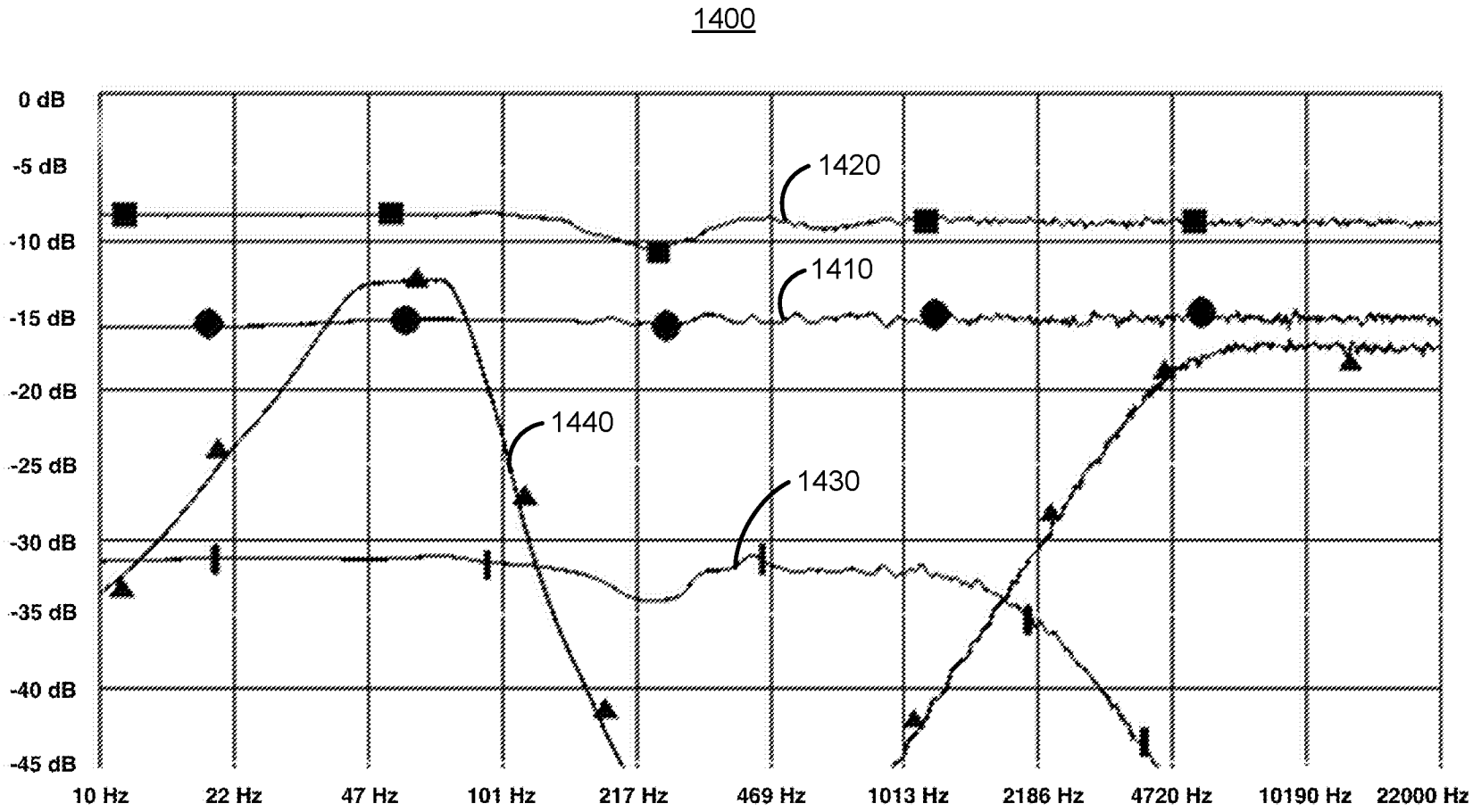
FIGS. 14 through 18 illustrate examples of frequency response plots of channel signals generated by the audio processing system, in accordance with one embodiment.

FIG. 14 illustrates a frequency plot 1400 of audio channels, in accordance with one embodiment. In plot 1400, the audio processing system 200 operates in a default setting where cascaded resonators (e.g., LF enhance band-pass filter 702 and LF enhance band-pass filter 704) of the high/low frequency booster 225 have a center frequency of 58.175 Hz and a Q factor of 2.5. Line 1410 is a frequency response of an audio input signal X of white noise on the left input channels $X_L$. Line 1420 is a frequency response of a subband spatial enhancer 210 that generates the spatially enhanced channel Y, given the same $X_L$ white noise input signal. Line 1430 is a frequency response of a crosstalk simulator 215 that generates a crosstalk channel C, given the same $X_L$ white noise input signal. Line 1440 is a frequency response of the high/low frequency booster 225 that generates the low and high frequency channels LF and HF, given the same $X_L$ white noise input signal. The L/R passthrough gain 606 is set to −infinity dB in the default setting, eliminating contribution of the passthrough channel P to the output signal O.

Figure 15:
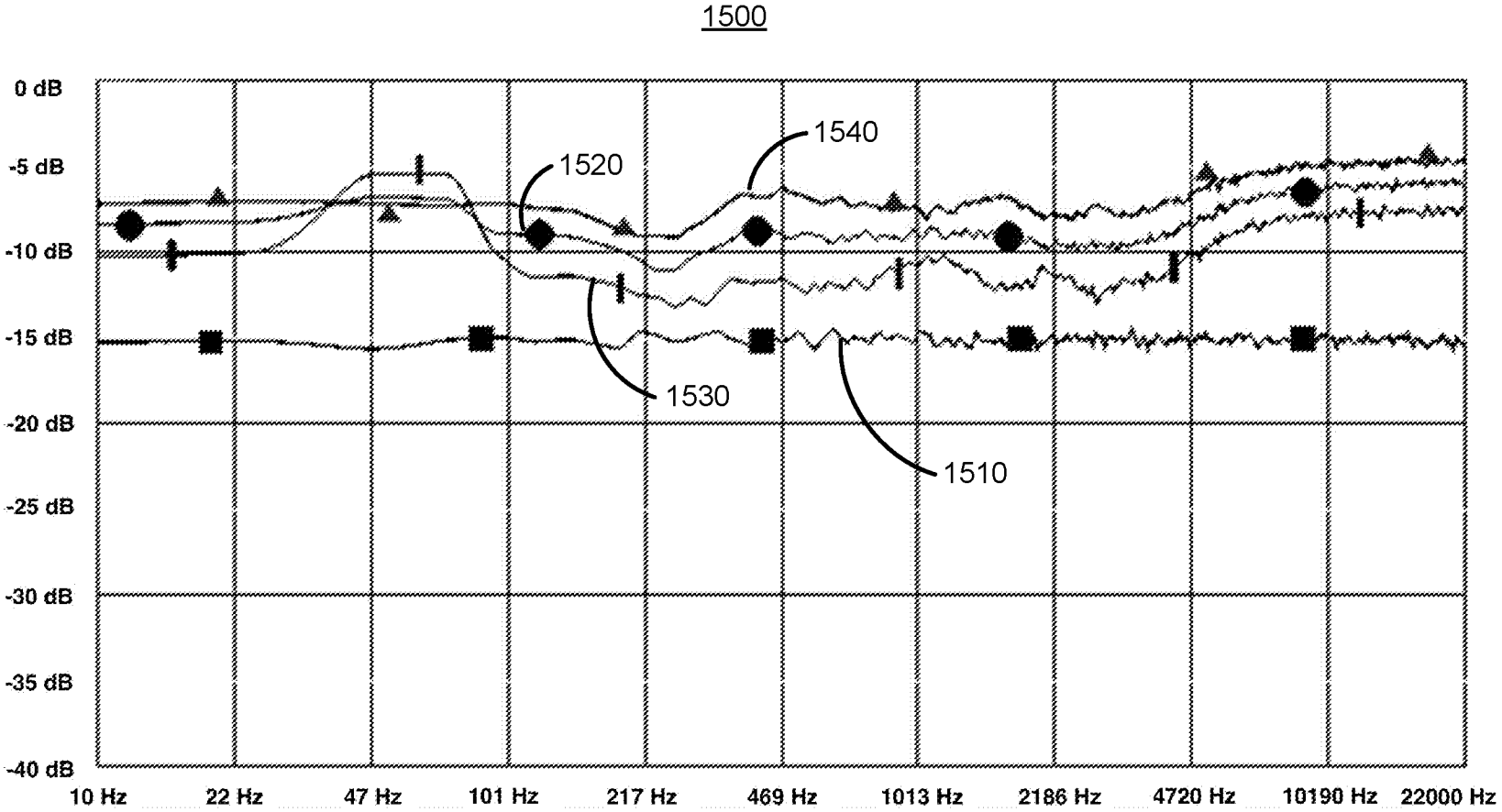

FIG. 15 illustrates a frequency plot 1500 of audio channels, in accordance with one embodiment. Line 1510 is a frequency response of an audio input signal X of white noise on the left input channels $X_L$. Like in plot 1400, the cascaded resonators (e.g., LF enhance band-pass filter 702 and LF enhance band-pass filter 704) of the high/low frequency booster 225 operate in the default setting where the band-pass filters have a center frequency of 58.175 Hz and a Q factor of 2.5. Line 1520 is a frequency response of the mixer 230 that generates the left output channel $O_L$, given the same $X_L$ white noise input signal Line 1530 is a frequency response of the mixer 230 that generates the left output channel $O_L$, given a correlated stereo white noise input signal (i.e. left and right signals are identical). Line 1540 is a frequency response of the mixer 230 that generates the left output channel $O_L$, given an uncorrelated white noise input signal (i.e. right channel is an inverted version of left channel)

Figure 16:
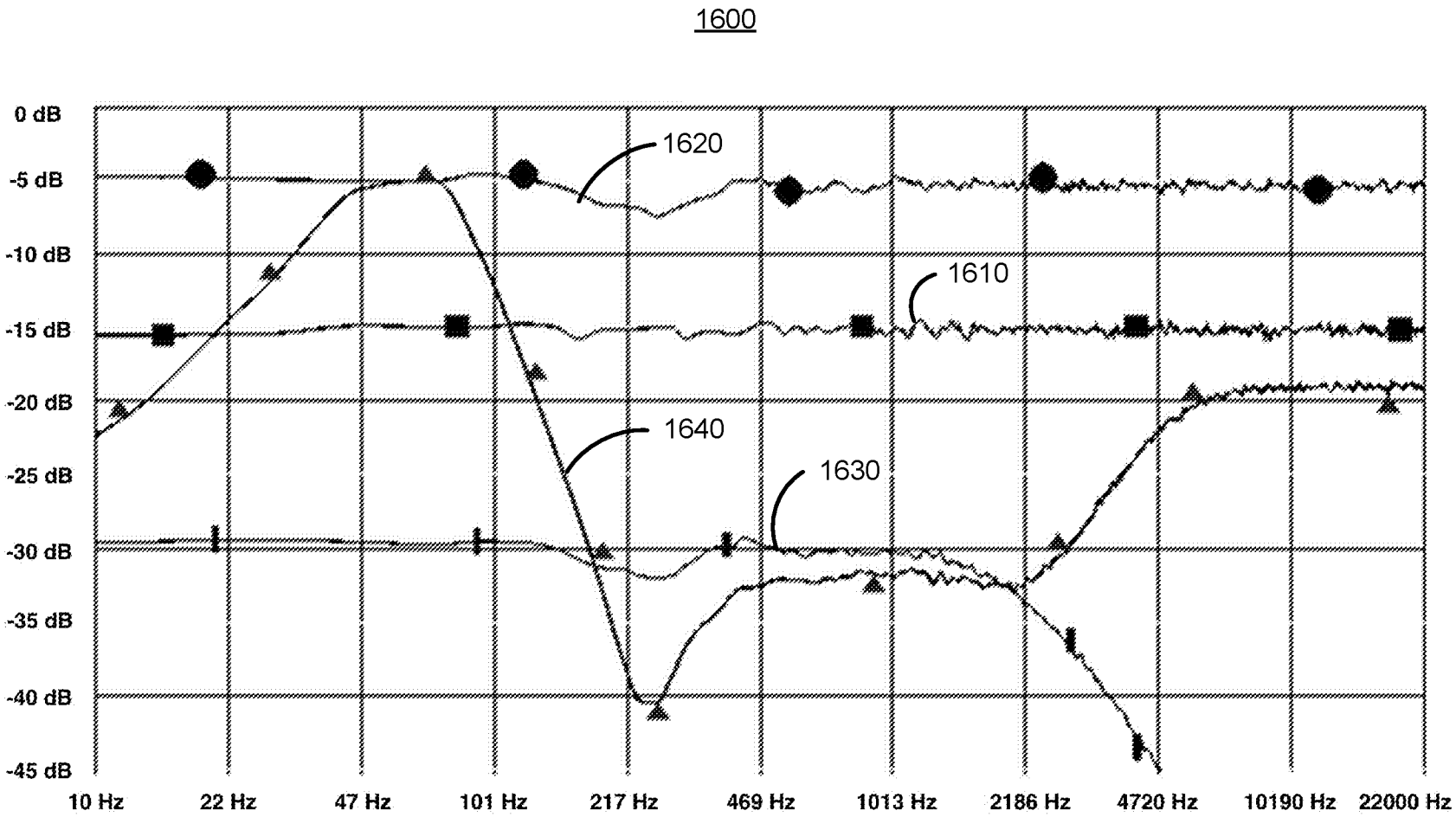

FIG. 16 illustrates a frequency plot 1600 of channel signals, in accordance with one embodiment. The audio processing system 200 operates in a boosted setting, where the cascaded resonators (e.g., LF enhance band-pass filter 702 and LF enhance band-pass filter 704) of the high/low frequency booster 225 have a center frequency of 58.175 Hz and a Q factor of 1.3. Line 1610 is a frequency response of an audio input signal X of white noise on the left input channels $X_L$. Line 1620 is a frequency response of a subband spatial enhancer 210 that generates the spatially enhanced channel Y, given the same $X_L$ white noise input signal. Line 1630 is a frequency response of a crosstalk simulator 215 that generates the crosstalk channel C, given the same $X_L$ white noise input signal. Line 1640 is a combined frequency response of the high/low frequency booster 225 and the passthrough 230 in the boosted setting, given the same $X_L$ white noise input signal.

Figure 17:
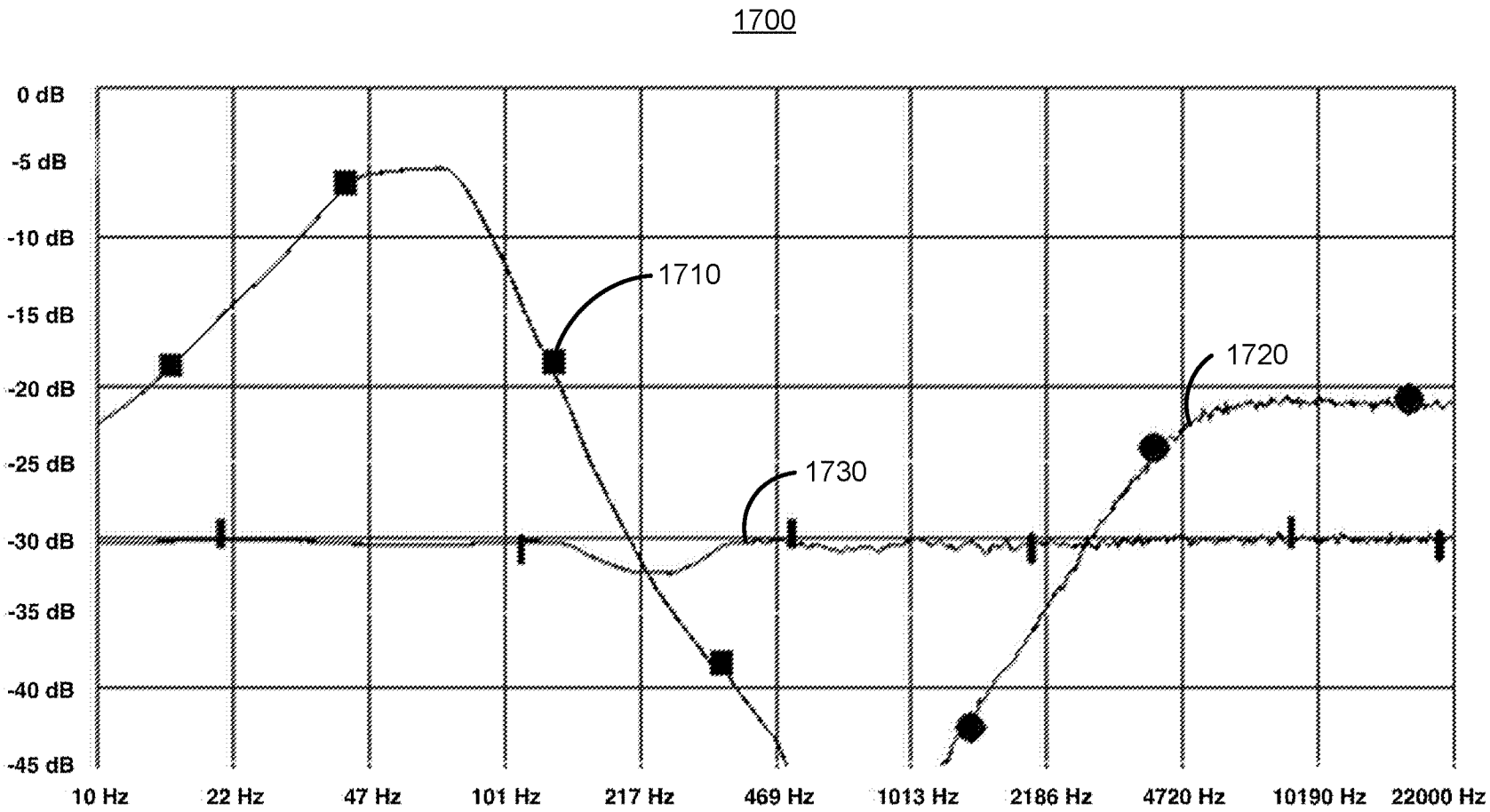

FIG. 17 illustrates individual components of line 1640 above. Line 1710 is a frequency response of the above low frequency enhancement. Line 1720 is a frequency response of the above high frequency filter enhancement. Line 1730 is a frequency response of the above passthrough 220. The lines 1710, 1720, and 1730 represent components of the combined filter response of line 1640 shown in FIG. 16 for the audio processing system 200 operating in the boosted setting.

Figure 18:
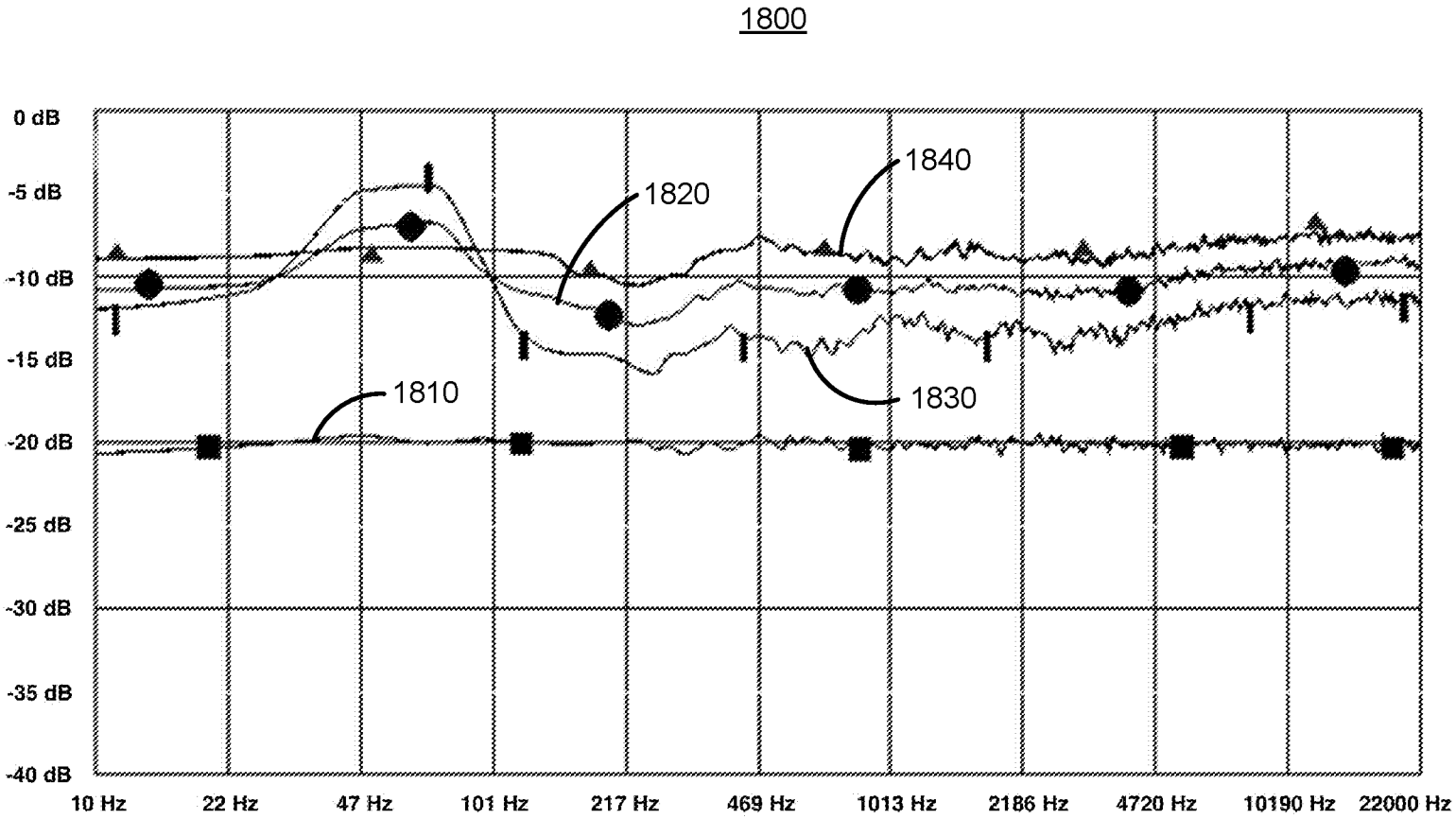

FIG. 18 illustrates a frequency plot 1800 of audio channels, in accordance with one embodiment. The audio processing system 200 operates in the boosted setting. Line 1810 is a frequency response of an audio input signal X of white noise on the left input channels $X_L$. Line 1820 is a frequency response of the mixer 230 that generates the left output channel $O_L$, given the same $X_L$ white noise input signal. Line 1830 is a frequency response plot of the mixer 230 that generates the left output channel $O_L$, given a correlated stereo white noise input signal (i.e. left and right signals are identical). Line 1840 is a frequency response of the mixer 230 that generates the left output channel $O_L$, given an uncorrelated white noise input signal (i.e. right channel is an inverted version of left channel).

Upon reading this disclosure, those of skill in the art will appreciate still additional alternative embodiments through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the scope described herein.

Any of the steps, operations, or processes described herein may be performed or implemented with one or more hardware or software modules, alone or in combination with other devices. In one embodiment, a software module is implemented with a computer program product comprising a computer readable medium (e.g., non-transitory computer readable medium) containing computer program code, which can be executed by a computer processor for performing any or all of the steps, operations, or processes described.

What is claimed is:

1. A method, comprising:

receiving an input audio signal comprising a left input channel and a right input channel;

generating a spatially enhanced left channel and a spatially enhanced right channel by gain adjusting side subband components and mid subband components of the left and right input channels;

generating a left crosstalk channel by filtering and time delaying the left input channel;

generating a right crosstalk channel by filtering and time delaying the right input channel;

generating a left output channel by mixing the spatially enhanced left channel and the right crosstalk channel; and generating a right output channel by mixing the spatially enhanced right channel and the left crosstalk channel.

2. The method of claim 1, wherein:

the method further includes generating a left low frequency channel and a right low frequency channel by:

applying a first band-pass filter to the left input channel and the right input channel;

applying a second band-pass filter to output of the first band-pass filter; and applying a gain to output of the second band-pass filter;

generating the left output channel includes mixing the spatially enhanced left channel, the right crosstalk channel, and the left low frequency channel; and generating the right output channel includes mixing the spatially enhanced right channel, the left crosstalk channel, and the right low frequency channel.

3. The method of claim 2, wherein the first and second band-pass filters each have a center frequency and adjustable quality (Q) factor.

4. The method of claim 1, wherein:

the method further includes generating a left high frequency channel and a right high frequency channel by:

applying a high-pass filter to the left input channel and the right input channel; and applying a gain to output of the high-pass filter;

generating the left output channel includes mixing the spatially enhanced left channel, the right crosstalk channel, and the left high frequency channel; and generating the right output channel includes mixing the spatially enhanced right channel, the left crosstalk channel, and the right high frequency channel.

5. The method of claim 4, wherein the high-pass filter is a second order Butterworth high-pass filter.

6. The method of claim 1, wherein:

the method further includes generating a left passthrough channel and a right passthrough channel by applying a gain to the left and right input channels;

generating the left output channel includes mixing the spatially enhanced left channel, the right crosstalk channel, and the left passthrough channel; and generating the right output channel includes mixing the spatially enhanced right channel, the left crosstalk channel, and the right passthrough channel.

7. The method of claim 1, wherein:

the method further includes generating a mid channel by:

adding the left input channel and the right input channel; and applying a gain to the added left and right input channels;

generating the left output channel includes mixing the spatially enhanced left channel, the right crosstalk channel, and the mid channel; and generating the right output channel includes mixing the spatially enhanced right channel, the left crosstalk channel, and the mid channel.

8. The method of claim 1, wherein generating the spatially enhanced left channel and the spatially enhanced right channel by gain adjusting side subband components and mid subband components of the left and right input channels includes:

separating the left input channel into left subband components, each of the left subband components corresponding to one frequency band from a group of frequency bands;

separating a right input channel into right subband components, each of the right subband components corresponding to one frequency band from the group of frequency bands;

generating the mid subband and the side subband components from the left and right subband components;

adjusting a gain of the side subband components relative to the mid subband components; and recombining the gain adjusted mid subband and side subband components to generate the left spatially enhanced channel and the right spatially enhanced channel.

9. The method of claim 1, wherein:

generating the spatially enhanced left channel and the spatially enhanced right channel includes applying a first gain to the side subband components and mid subband components of the left and right input channels;

generating the left crosstalk channel includes applying a second gain to the filtered and time delayed left input channel;

generating the right crosstalk channel includes applying the second gain to the filtered and time delayed right input channel;

the method further includes:

generating a left low frequency channel and a right low frequency channel by:

applying a first band-pass filter to the left input channel and the right input channel;

applying a second band-pass filter to output of the first band-pass filter; and applying a third gain to output of the second band-pass filter;

generating a left high frequency channel and a right high frequency channel by:

applying a high-pass filter to the left input channel and the right input channel; and applying a fourth gain to output of the high-pass filter;

generating a left passthrough channel and a right passthrough channel by applying a fifth gain to the left and right input channels; and generating a mid channel by:

adding the left input channel and the right input channel; and applying a sixth gain to the added left and right input channels;

generating the left output channel includes mixing the spatially enhanced left channel, the right crosstalk channel, the left low frequency channel, the left high frequency channel, the left passthrough channel, and the mid channel; and generating the right output channel includes mixing the spatially enhanced right channel, the left crosstalk channel, the right low frequency channel, the right high frequency channel, the right passthrough channel, and the mid channel.

10. The method of claim 9, wherein:

the first gain is in the range of a −12 to 6 dB gain;

the second gain is in the range of a −infinity to 0 dB gain;

the third gain is in the range of a 0 to 20 dB gain;

the fourth gain is in the range of a 0 to 20 dB gain;

the fifth gain is in the range of a −infinity to 0 dB gain; and the sixth gain is in the range of a −infinity to 0 dB gain.

11. An audio processing system, comprising:

a subband spatial enhancer configured to generate a spatially enhanced left channel and a spatially enhanced right channel by gain adjusting side subband components and mid subband components of a left input channel and a right input channel;

a crosstalk simulator configured to:

generate a left crosstalk channel by filtering and time delaying the left input channel; and generate a right crosstalk channel by filtering and time delaying the right input channel; and a mixer configured to:

generate a left output channel by mixing the spatially enhanced left channel and the right crosstalk channel; and generate a right output channel by mixing the spatially enhanced right channel and the left crosstalk channel.

12. The system of claim 11, wherein:

the system further includes a frequency booster configured to generate a left low frequency channel and a right low frequency channel, the frequency booster including:

a first band-pass filter configured to filter the left input channel and the right input channel;

a second band-pass filter configured to filter output of the first band-pass filter; and a low frequency filter gain to apply a gain to output of the second band-pass filter;

the mixer configured to generate the left output channel includes the mixer being configured to mix the spatially enhanced left channel, the right crosstalk channel, and the left low frequency channel; and the mixer configured to generate the right output channel includes the mixer being configured to mix the spatially enhanced right channel, the left crosstalk channel, and the right low frequency channel.

13. The system of claim 12, wherein the first and second band-pass filters each have a center frequency and adjustable quality (Q) factor.

14. The system of claim 11, wherein:

the system further includes a frequency booster configured to generate a left high frequency channel and a right high frequency channel, the frequency booster including:

a high-pass filter configured to filter the left input channel and the right input channel; and a high frequency filter gain to apply a gain to output of the high-pass filter;

the mixer configured to generate the left output channel includes the mixer being configured to mix the spatially enhanced left channel, the right crosstalk channel, and the left high frequency channel; and the mixer configured to generate the right output channel includes the mixer being configured to mix the spatially enhanced right channel, the left crosstalk channel, and the right high frequency channel.

15. The system of claim 14, wherein the high-pass filter is a second order Butterworth high-pass filter.

16. The system of claim 11, wherein:

the system further includes a passthrough configured to generate a left passthrough channel and a right passthrough channel, the passthrough including a passthrough gain configured to apply a gain to the left and right input channels;

the mixer configured to generate the left output channel includes the mixer being configured to mix the spatially enhanced left channel, the right crosstalk channel, and the left passthrough channel; and the mixer configured to generate the right output channel includes the mixer being configured to mix the spatially enhanced right channel, the left crosstalk channel, and the right passthrough channel.

17. The system of claim 11, wherein:

the system further includes a passthrough configured to generate a mid channel, the passthrough including:

a combiner configured to add the left input channel and the right input channel; and a mid gain configured to apply a gain to the added left and right input channels;

the mixer configured to generate the left output channel includes the mixer being configured to mix the spatially enhanced left channel, the right crosstalk channel, and the left mid channel; and the mixer configured to generate the right output channel includes the mixer being configured to mix the spatially enhanced right channel, the left crosstalk channel, and the right mid channel.

18. The system of claim 11, wherein the subband spatial enhancer configured to generate the spatially enhanced left channel and the spatially enhanced right channel by gain adjusting side subband components and mid subband components of the left input channel and the right input channel includes the subband spatial enhancer being configured to:

separate the left input channel into left subband components, each of the left subband components corresponding to one frequency band from a group of frequency bands;

separate a right input channel into right subband components, each of the right subband components corresponding to one frequency band from the group of frequency bands;

generate the mid subband and the side subband components from the left and right subband components;

adjust a gain of the side subband components relative to the mid subband components; and recombine the gain adjusted mid subband and side subband components to generate the left spatially enhanced channel and the right spatially enhanced channel.

19. The system of claim 11, wherein:

the subband spatial enhancer configured to generate the spatially enhanced left channel and the spatially enhanced right channel includes the subband spatial enhancer being configured to apply a first gain to the side subband components and mid subband components of the left and right input channels;

the crosstalk simulator configured to generate the left crosstalk channel includes the crosstalk simulator being configured to apply a second gain to the filtered and time delayed left input channel;

the crosstalk simulator configured to generate the right crosstalk channel includes the crosstalk simulator being configured to apply the second gain to the filtered and time delayed right input channel;

the system further includes:

a frequency booster configured to generate a left low frequency channel, a right low frequency channel, a left high frequency channel, and a right high frequency channel, the frequency booster including:

a first band-pass filter configured to filter the left input channel and the right input channel;

a second band-pass filter configured to filter output of the first band-pass filter;

a low frequency filter gain configured to apply a third gain to output of the second band-pass filter to generate the left low frequency channel and the right low frequency channel;

a high-pass filter configured to filter the left input channel and the right input channel; and a high frequency filter gain configured to apply a fourth gain to output of the high-pass filter to generate the left high frequency channel and the right high frequency channel;

a passthrough configured to generate a left passthrough channel, a right passthrough channel, and a mid channel, the passthrough including:

a passthrough gain configured to apply a fifth gain to the left and right input signals to generate the left passthrough channel and the right passthrough channel;

a combiner configured to add the left input channel and the right input channel; and a mid gain configured to apply a sixth gain to the added left and right input channels to generate the left mid channel and the right mid channel;

the mixer configured to generate the left output channel includes the mixer being configured to mix the spatially enhanced left channel, the right crosstalk channel, the left low frequency channel, the left high frequency channel, the left passthrough channel, and the mid channel; and the mixer configured to generate the right output channel includes the mixer being configured to mix the spatially enhanced right channel, the left crosstalk channel, the right low frequency channel, the right high frequency channel, the right passthrough channel, and the mid channel.

20. A non-transitory computer readable medium configured to store program code, the program code comprising instructions that when executed by a processor cause the processor to:

receive an input audio signal comprising a left input channel and a right input channel;

generate a spatially enhanced left channel and a spatially enhanced right channel by gain adjusting side subband components and mid subband components of the left and right input channels;

generate a left crosstalk channel by filtering and time delaying the left input channel;

generate a right crosstalk channel by filtering and time delaying the right input channel;

generate a left output channel by mixing the spatially enhanced left channel and the right crosstalk channel; and generate a right output channel by mixing the spatially enhanced right channel and the left crosstalk channel.

* * * * *